US006818313B2

(12) United States Patent
Phelps et al.

(10) Patent No.: US 6,818,313 B2
(45) Date of Patent: Nov. 16, 2004

(54) CORROSION-INHIBITING COATING

(75) Inventors: Andrew W. Phelps, Kettering, OH (US); Jeffrey A. Sturgill, Fairborn, OH (US)

(73) Assignee: University of Dayton, Dayton, OH (US)

( * ) Notice: Subject to any disclaimer, the term of this patent is extended or adjusted under 35 U.S.C. 154(b) by 5 days.

(21) Appl. No.: 10/202,589

(22) Filed: Jul. 24, 2002

(65) Prior Publication Data

US 2004/0016363 A1 Jan. 29, 2004

(51) Int. Cl.[7] ..... C23C 18/00

(52) U.S. Cl. ..... 428/457; 106/1.17; 106/1.22; 106/1.29; 148/243; 148/247; 148/253; 148/258; 148/259; 148/260; 148/261; 428/469; 428/470; 428/472; 428/472.1; 428/472.2; 428/472.3

(58) Field of Search ..... 106/1.17, 1.22, 106/1.29; 148/243, 247, 253, 258, 259, 260, 261; 428/457, 469, 470, 472, 472.1, 472.2, 472.3

(56) References Cited

U.S. PATENT DOCUMENTS

| | | | | | |
|---|---|---|---|---|---|
| 4,746,411 | A | * | 5/1988 | Klos et al. | 205/245 |
| 5,116,664 | A | | 5/1992 | Kimura et al. | |
| 5,186,812 | A | * | 2/1993 | Shiohara et al. | 205/141 |
| 5,304,403 | A | * | 4/1994 | Schlesinger et al. | 427/437 |
| 5,405,523 | A | | 4/1995 | Eckles | |
| 5,417,840 | A | * | 5/1995 | Block et al. | 205/246 |
| 5,435,898 | A | | 7/1995 | Commander et al. | |
| 5,456,950 | A | | 10/1995 | Wood et al. | |
| 5,529,810 | A | | 6/1996 | Sugawara | |
| 5,582,709 | A | | 12/1996 | Oshima et al. | |
| 5,650,238 | A | | 7/1997 | Urakawa et al. | |
| 6,106,689 | A | * | 8/2000 | Matsuyama | 205/333 |
| 6,176,996 | B1 | * | 1/2001 | Moon | 205/254 |

FOREIGN PATENT DOCUMENTS

| | | | | |
|---|---|---|---|---|
| DE | 2610603 | A | * | 9/1977 |
| DE | 3236115 | A1 | | 3/1984 |
| EP | 0 038 122 | A | | 10/1981 |
| GB | 2 006 831 | A | | 5/1979 |
| JP | 55-164067 | A | * | 12/1980 |
| JP | 56-136965 | A | * | 10/1981 |
| JP | 56-136966 | A | * | 10/1981 |
| JP | 57039165 | | | 3/1982 |
| JP | 57047864 | | | 3/1982 |
| JP | 60-59521 | A | * | 4/1985 |
| JP | 63-83283 | A | * | 4/1988 |
| JP | 03-17278 | A | * | 1/1991 |
| JP | 03-98779 | A | * | 3/1991 |
| JP | 3191070 | | | 8/1991 |
| JP | 3-260095 | A | * | 11/1991 |
| JP | 3287777 | | | 12/1991 |
| JP | 4106931 | | | 4/1992 |
| JP | 4-236788 | A | * | 8/1992 |
| JP | 5082524 | | | 4/1993 |
| JP | 5222575 | | | 8/1993 |
| WO | WO 96/21752 | A | | 7/1996 |
| WO | WO 98/56963 | A | | 12/1998 |

OTHER PUBLICATIONS

Derwent Abstract No. 2001–266557, abstract of Switzerland Patent Specification No. 1150183 A (Nov. 1995).*

* cited by examiner

*Primary Examiner*—Anthony J Green
(74) *Attorney, Agent, or Firm*—Dinsmore & Shohl LLP

(57) ABSTRACT

A corrosion-inhibiting coating, process, and system that provides a tight, adherent zinc- or zinc-alloy coating that is directly deposited onto steel or cast iron surfaces for enhanced corrosion protection. A process for applying the coating is also provided. The process includes the application of two sequential aqueous baths. The first bath contains a precursor zinc compound while the second bath contains a reducing agent to deposit the zinc directly upon the steel or cast iron.

30 Claims, No Drawings

CORROSION-INHIBITING COATING

BACKGROUND

The present invention relates to a corrosion-inhibiting coating, process for creating the corrosion-inhibiting coating, and a corrosion-inhibiting coating bath. More specifically, the present invention relates to a coating, process, and system using zinc- or a zinc-alloy as an adherent that is directly deposited onto a steel surface for enhanced corrosion protection.

Steel or cast iron materials such as those used for fasteners, automotive bodies, and industrial processing equipment require protection from corrosion due to the low oxidation-reduction (redox) potential of iron. Typically, these materials are coated with a thin "sacrificial" coating of a material with an even lower redox potential. The two materials that are typically used as sacrificial materials for steels are cadmium and zinc, or alloys composed of the same. During corrosive attack, these cadmium or zinc sacrificial materials are themselves preferentially corroded, maintaining the structural integrity of the underlying steel.

In instances where these sacrificial materials are removed from the steel surface, corrosive attack of the underlying steel will begin. For example, if the zinc layer which protects the steel is removed, then the underlying steel begins to corrode. Additionally, if the steel is galvanically coupled to a third metal that has a lower redox potential than iron, then that third metal will begin to corrode once the "sacrificial" layer of zinc or cadmium is removed. This process is frequently observed during aircraft maintenance procedures. Cadmium-plated steel fasteners are used in aluminum alloy wing and fuselage sections. During routine maintenance, the cadmium plate is frequently removed from the fasteners, setting up a steel-aluminum galvanic couple. This inevitably results in corrosion of the lower redox potential material (aluminum).

A method of replacing this sacrificial layer over the steel surfaces is therefore advantageous for many applications. Zinc and zinc-containing alloys are preferred for this application, due to the toxic nature of cadmium. However, the conventional methods of applying zinc (e.g., electroplating or hot-dip processes) are not suitable for this application because neither is practical to repair the steel piece without removal of that part or steel piece. In addition, both processes require a large degree of energy expenditure in order to perform a simple repair operation. Therefore, replating an automotive or aircraft component in the field in order to replace this sacrificial layer will require a large electrical expenditure. The application of a molten zinc layer to a structure in need of repair requires a high temperature (419.5° C.), but this high temperature may damage other structural components.

Another method involves the incorporation of zinc dust or a zinc metal-zinc oxide mixture within a polymer film (e.g., a paint), which is then applied directly onto the steel surface (i.e., zincrometal). This severely limits the successful application of conversion or phosphate coatings for subsequent paint application. In order to function properly, conversion or phosphate coatings must be applied directly onto a metal surface (e.g., zinc). Application of barrier films that contain zinc dust may result in superior corrosion protection, but the resultant adhesion to such barrier film coatings is poor.

Kimura et al. (U.S. Pat. No. 5,116,664) teaches using electroless plating where the electroless plating bath contains a metal salt, including zinc salts, and a reducing agent, including sodium hypophosphate. The electroless plating bath may also contain chelating stabilizers and buffers. However, Kimura teaches using such plating system to create a titanium-mica composite material and not for corrosion protection of steel surplus. Also, Kimura does not disclose using a fluoride preparative in his bath.

Thus, there is a need in the art for a coating which provides superior adhesion and corrosion protection for steel surfaces.

SUMMARY OF THE INVENTION

This need is met by the present invention which provides an electroless zinc coating for corrosion protection of steel surfaces. The present invention utilizes improved electroless zinc deposition techniques to achieve a tight, adherent zinc coating that is directly applied to the steel surface.

In accordance with one embodiment of the present invention, a corrosion-inhibiting coating is provided comprising a zinc source, a complexing agent for the zinc source, and a reducing agent. Generally, the zinc source is water-soluble. Generally, the zinc source is selected from zinc chloride, zinc bromide, zinc iodide, zinc sulfate, zinc chlorate, zinc nitrate, zinc perchlorate, zinc bromate, zinc acetate, zinc fluosilicate, zinc permanganate, zinc propionate, zinc citrate, zinc butyrate, zinc formate, zinc fluoride, zinc lactate, or zinc benzoate. The zinc source may have a zinc concentration greater than or equal to 1.0 M and less than or equal to the maximum solubility of the zinc source in water. Preferably, the zinc source may have a concentration from about 2.5M to about 5.0M.

The coating further comprising a preparative agent. Generally, the preparative agent is a fluoride source. Generally, the fluoride source is selected from hydrofluoric acid, ammonium fluoride, lithium fluoride, sodium fluoride, potassium fluoride, potassium bifluoride, zinc fluoride, aluminum fluoride, hexafluorozirconates, hexafluorotitanates, hexafluorosilicates, fluoroaluminates, fluoroborates, fluorophosphates, or fluoroantimonates. The preparative agent may be selected from sulfuric acid, hydrochloric acid, hydrobromic acid, hydriodic acid, phosphoric acid, phosphorous acid, boric acid, or carboxylic acid. Preferably, the preparative agent is a concentration from about 0.2M to about 0.6M.

The complexing agent may be a nitrogen-containing compound. Generally, the nitrogen-containing compound is selected from ammonium compounds, substituted ammonium, ammonia, amines, aromatic amines, porphyrins, amidines, diamidines, guanidines, diguanidines, polyguanidines, biguanides, biguanidines, imidotricarbonimidic diamides, imidotetracarbonimidic diamides, dibiguanides, bis(biguanidines), polybiguanides, poly(biguanidines), imidosulfamides, diimidosulfamides, bis(imidosulfamides), bis(diimidosulfamides), poly(imidosulfamides), poly(diimidosulfamides), phosphoramidimidic triamides, bis(phosphoramidimidic triamides), poly(phosphoramidimidic triamides), phosphoramidimidic acid, phosphorodiamidimidic acid, bis(phosphoramidimidic acid), bis(phosphorodiamidimidic acid), poly(phosphoramidimidic acid), poly(phosphorodiamidimidic acid), phosphonimidic diamides, bis(phosphonimidic diamides), poly(phosphonimidic diamides), phosphonamidimidic acid, bis(phosphonamidimidic acid), poly(phosphonamidimidic acid), azo compounds, formazan compounds, azine compounds, Schiff Bases, hydrazones, or hydramides.

The complexing agent may be a phosphorus-containing compound. Generally, the phosphorous-containing compound is selected from phosphines, aromatic phosphines, or substituted phosphonium ions ($PR_4^+$) wherein R is an alkyl, aromatic, or acyclic organic constituent of a $C_1$ to $C_8$. A ratio of complexing agent to the zinc source is generally from about 0.5:1 to about 4:1. Preferably, the ratio of the complexing agent to the zinc source may be from about 2:1 to about 4:1.

The reducing agent typically has a reduction potential lower than −0.76 volts in acidic conditions. Generally, the reducing agent has a reduction potential lower than −1.04 volts under basic conditions. Generally, the reducing agent is selected from formate, borohydride, tetraphenylborate, hypophosphite, hydroxylamine, hydroxamates, dithionite, trivalent titanium, trivalent vanadium, or divalent chromium. Preferably, the reducing agent has a concentration greater than or equal to 0.5M but less than or equal to 1.0M.

The coating may further comprise an additional metal source. Generally, the additional metal source is selected from manganese, cadmium, iron, tin, copper, nickel, indium, lead, antimony, bismuth, cobalt, or silver.

The coating may further comprise a thickening agent. The thickening agent is generally selected from starch, dextrin, gum arabic, albumin, gelatin, glue, saponin, gum mastic, gum xanthan, hydroxyalkyl celluloses, polyvinyl alcohols, polyacrylic acid and its esters, polyacrylamides, ethylene oxide polymers, polyvinylpyrrolidone, alkyl vinyl ether copolymers, colloidal suspensions of aluminum oxide or hydrated aluminum oxide, colloidal suspensions of magnesium oxide or hydroxide, or colloidal suspensions of silicon or titanium oxides. Generally, the coating comprises between about 0.1 to about 50 parts by weight per 100 parts by weight of water of a thickening agent. Preferably, the coating may comprise between about 0.1 to about 20 parts by weight per 100 parts by weight of water of a thickening agent.

In another embodiment of the present invention, a process for creating a corrosion-inhibiting coating is provided comprising the steps of preparing a first bath, preparing a second bath containing a reducing agent, providing a steel surface, depositing the first bath onto the steel surface, and then, depositing the second bath onto the steel surface. The first bath generally comprises a zinc source and a complexing agent for the zinc. The process may further comprise the step of precleaning the steel surface prior to depositing the first bath onto the steel surface. The process may further comprise masking a portion of the steel surface prior to depositing the first bath onto the steel surface. The process may further comprise the step of rinsing the steel surface after depositing the second bath onto the steel surface. The process may further comprise the step of drying the steel surface after depositing the second bath onto the steel surface. The zinc source may have a concentration greater than or equal to 1.0 M and less than or equal to the maximum solubility of the zinc source in water. Generally, the zinc source is water-soluble. Generally, the zinc source is selected from zinc chloride, zinc bromide, zinc iodide, zinc sulfate, zinc chlorate, zinc nitrate, zinc perchlorate, zinc bromate, zinc acetate, zinc fluosilicate, zinc permanganate, zinc propionate, zinc citrate, zinc butyrate, zinc formate, zinc fluoride, zinc lactate, or zinc benzoate. Preferably, the zinc source has a concentration from about 2.5M to about 5.0M.

The first bath may further comprises a preparative agent. The preparative agent is generally a fluoride source. The fluoride source is typically selected from hydrofluoric acid, ammonium fluoride, lithium fluoride, sodium fluoride, potassium fluoride, potassium bifluoride, zinc fluoride, aluminum fluoride, hexafluorozirconates, hexafluorotitanates, hexafluorosilicates, fluoroaluminates, fluoroborates, fluorophosphates, or fluoroantimonates. The preparative agent may be selected from sulfuric acid, hydrochloric acid, hydrobromic acid, hydriodic acid, phosphoric acid, phosphorous acid, boric acid, or carboxylic acid. Preferably, the preparative agent has a concentration from about 0.2M to about 0.6M. The complexing agent may be a nitrogen-containing compound. Generally, the nitrogen-containing compound is selected from an ammonium compound, substituted ammonium, ammonia, amines, aromatic amines, porphyrins, amidines, diamidines, guanidines, diguanidines, polyguanidines, biguanides, biguanidines, imidotricarbonimidic diamides, imidotetracarbonimidic diamides, dibiguanides, bis(biguanidines), polybiguanides, poly(biguanidines), imidosulfamides, diimidosulfamides, bis(imidosulfamides), bis(diimidosulfamides), poly(imidosulfamides), poly(diimidosulfamides), phosphoramidimidic triamides, bis(phosphoramidimidic triamides), poly(phosphoramidimidic triamides), phosphoramidimidic acid, phosphorodiamidimidic acid, bis(phosphoramidimidic acid), bis(phosphorodiamidimidic acid), poly(phosphoramidimidic acid), poly(phosphorodiamidimidic acid), phosphonimidic diamides, bis(phosphonimidic diamides), poly(phosphonimidic diamides), phosphonamidimidic acid, bis(phosphonamidimidic acid), poly(phosphonamidimidic acid), azo compounds, formazan compounds, azine compounds, Schiff Bases, hydrazones, or hydramides. The complexing agent may be a phosphorus-containing compound. The phosphorous-containing compound is generally selected from phosphines, aromatic phosphines, or substituted phosphonium ions ($PR_4^+$) wherein R is an alkyl, aromatic, or acyclic organic constituent of a $C_1$ to $C_8$. The ratio of the complexing agent to the zinc source is typically from about 0.5:1 to about 4:1. The ratio of the complexing agent to the zinc source may be from about 2:1 to about 4:1. Generally, the reducing agent has a reduction potential lower than about −0.76 volts in acidic conditions. Generally, the reducing agent has a reduction potential lower than about −1.04 volts under basic conditions. Generally, the reducing agent is selected from formate, borohydride, tetraphenylborate, hypophosphite, hydroxylamine, hydroxamates, dithionite, trivalent titanium, trivalent vanadium, or divalent chromium. Generally, the reducing agent has a concentration greater than or equal to 0.5M but less than or equal to 1.0M.

The first bath may further comprise an additional metal source. Generally, the additional metal source is selected from manganese, cadmium, iron, tin, copper, nickel, indium, lead, antimony, bismuth, cobalt, or silver. The first bath may further comprise a thickening agent. Generally, the thickening agent is selected from starch, dextrin, gum arabic, albumin, gelatin, glue, saponin, gum mastic, gum xanthan, hydroxyalkyl celluloses, polyvinyl alcohols, polyacrylic acid and its esters, polyacrylamides, ethylene oxide polymers, polyvinylpyrrolidone, alkyl vinyl ether copolymers, colloidal suspensions of aluminum oxide or hydrated aluminum oxide, colloidal suspensions of magnesium oxide or hydroxide, or colloidal suspensions of silicon or titanium oxides. Generally, the coating comprises between about 0.1 to about 50 parts by weight per 100 parts by weight of water of a thickening agent. Preferably, the coating may comprise between about 0.1 to about 20 parts by weight per 100 parts by weight of water of a thickening agent.

In yet another embodiment of the present invention, a process for creating a corrosion-inhibiting coating is provided comprising the steps of providing a steel surface; precleaning the steel surface; masking the steel surface; rinsing the steel surface; applying a first bath to the steel surface wherein the first bath comprises a zinc source, a preparative agent, and a complexing agent for the zinc; applying a second bath to said steel surface wherein the second bath comprises a strong reducing agent; rinsing the steel surface; and drying the steel surface.

In another embodiment of the present invention, a process for creating a corrosion-inhibiting coating is provided comprising the steps of applying a first bath to the steel surfaces wherein the first bath comprises a zinc source, a complexing agent for the zinc, and a preparative agent. The process may further include the step of applying a second bath to the steel surfaces wherein the second bath comprises a reducing agent.

In another embodiment of the present invention, a corrosion-inhibiting system is provided comprising a first bath wherein the first bath comprises a zinc source and a complexing agent for the zinc source. The system may further comprise a preparative agent. Generally, the preparative agent is a fluoride source. Generally, the fluoride is selected from the group consisting of hydrofluoric acid, ammonium fluoride, lithium fluoride, sodium fluoride, potassium fluoride, potassium bifluoride, zinc fluoride, aluminum fluoride, hexafluorozirconates, hexafluorotitanates, hexafluorosilicates, fluoroaluminates, fluoroborates, fluorophosphates, and fluoroantimonates. They system may further comprise a second bath containing a reducing agent. The reducing agent generally has a reduction potential lower than −0.76 volts in acidic conditions. Generally, the reducing agent has a reduction potential lower than −1.04 volts under basic conditions. The first bath may further comprise an additional metal source. The first bath may further comprise an organic thickening agent.

Accordingly, it is an object of the invention to provide a corrosion-inhibiting coating, a process for creating the corrosion-inhibiting coating, and a process for creating a corrosion-inhibiting coating bath. Other objects of the invention will become apparent in light of the description of the invention embodied herein.

DETAILED DESCRIPTION

The application of a new sacrificial layer directly onto the steel surface can be accomplished through the use of an electroless plating procedure. The use of electroless plating results in the formation of a sacrificial layer directly upon the steel surface; which can then be conversion coated or phosphated for subsequent paint adhesion. The present invention utilizes electroless zinc deposition techniques to achieve a tight, adherent zinc coating directly onto a steel surface. The zinc coating may be applied by immersion, spray or manual means. More specifically, in order to achieve a high degree of corrosion resistance, the electroless deposition of zinc can be performed by a two-step process that can occur at ambient conditions. Heating of the coating solutions is not necessary.

The four general starting materials for the electroless composition include a zinc source, an optional preparative agent source, a complexing agent source, and a reducing agent or "fixer". The zinc source, preparative agent source, and complexing agent source may be combined in the first bath. The reducing agent may be used in the second bath. These materials may be included as neat compounds in the electroless zinc baths, or may be added to the baths as already-prepared solutions.

The zinc precursor material can be any zinc compound. Water-soluble compounds are desirable, so that water can be the carrier solvent. Examples of inorganic zinc precursor compounds include but are not restricted to: zinc nitrate, zinc sulfate, zinc perchlorate, zinc chloride, zinc fluoride, zinc bromide, zinc iodide, zinc bromate, zinc chlorate, and complex fluorides such as zinc fluosilicate, zinc fluotitanate, zinc fluozirconate, zinc fluoborate, and zinc fluoaluminate. Examples of organometallic zinc precursor compounds include but are not restricted to: zinc formate, zinc acetate, zinc propionate, zinc butyrate, zinc benzoate, zinc citrate, and zinc lactate.

The use of zinc compounds in which the zinc ion is bound to a reducible anion (e.g., nitrate, perchlorate, bromate, permanganate, or chlorate), is less desirable because much of the reducing agent ("fixer") which is to be used for zinc reduction will instead be preferentially consumed by the anion. This can lead to a lower amount of deposited zinc.

It is desirable that the zinc precursors be sufficiently soluble in water, so that the resultant solution can achieve the optimum concentration of about 2.5 to about 5.0 M $Zn^{+2}$ ions. Table 1 shows the maximum reported solubilities of some zinc precursors. As can be seen, carboxylates of zinc, as well as the zinc fluorides, are less desirable due to their lower solubility in water. Typical zinc sources for this process are zinc chloride, zinc bromide, zinc iodide, and zinc sulfate.

TABLE 1

Maximum Solubility of Some Zinc Precursors (moles/liter $Zn^{+2}$ at 20 to 30° C.)

| Zinc Source | Solubility | Comments |
|---|---|---|
| Zinc chloride | 31.7 | Desirable zinc source |
| Zinc bromide | 19.8 | Desirable zinc source |
| Zinc iodide | 13.5 | Desirable zinc source |
| Zinc sulfate | 3.4 | Desirable zinc source |
| Zinc chlorate | 8.6 | Less desirable zinc source due to reducible anion |
| Zinc nitrate | 6.2 | Less desirable zinc source due to reducible anion |
| Zinc perchlorate | ~5.0 | Less desirable zinc source due to reducible anion |
| Zinc bromate | ~5.0 | Less desirable zinc source due to reducible anion |
| Zinc acetate | 1.6 | Less desirable zinc source due to low solubility |
| Zinc fluosilicate | ~1.0 | Less desirable zinc source due to low solubility |
| Zinc permanganate | 0.8 | Less desirable zinc source due to reducible anion |
| Zinc propionate | ~0.7 | Less desirable zinc source due to low solubility |
| Zinc citrate | 0.5 | Less desirable zinc source due to low solubility |
| Zinc butyrate | 0.4 | Less desirable zinc source due to low solubility |
| Zinc formate | 0.3 | Less desirable zinc source due to low solubility |
| Zinc fluoride | 0.2 | Less desirable zinc source due to low solubility |
| Zinc lactate | 0.2 | Less desirable zinc source due to low solubility |
| Zinc benzoate | 0.1 | Less desirable zinc source due to low solubility |

The maximum concentration of zinc in the solution is typically the maximum concentration of the precursor salt in water, as is shown in Table 1. At concentrations higher than this range, undissolved zinc precursor can result. Typically, the minimum concentration of the zinc precursor is approximately 1.0 M. At concentrations lower than this, insufficient zinc can be available for reduction and hence deposition.

Optimally, however, the concentration range of zinc in the first solution should be greater than or equal to about 2.5 M, but less than or equal to about 5.0 M. Zinc concentrations less than about 2.5 M typically result in thin deposits of zinc that are nonuniform in coverage, which may result in inadequate corrosion protection. Zinc concentrations greater than about 5.0 M may result in white deposits of zinc phosphate in the formed electroless zinc coating. These may adversely affect any subsequent conversion coating or phosphating application on the deposited zinc. Concentrations higher than about 5.0 M can also raise the cost of the plating process.

The second component of the composition maybe a preparative agent source. This component is optional. The preparative agent may not be necessary if the material to be treated is relatively clean, (i.e. deoxidized) and/or if pretreatment with a reducing agent is applied to the material. If the pretreatment with a reducing agent is applied, then the reducing agent may serve as the preparative agent.

The preparative agent source is desirable because uniform film growth is better achieved if the electroless zinc coat is contacted with bare metal. Thus, removal of the native oxide layer is desirable to achieve high-quality films. Because this is the first step in the film deposition process, agents that perform this function are termed "preparative agents" or "activators" for the entire process. These preparative agents remove (dissolve) the inherent oxide coating on the metals, providing a bare metal surface upon which to deposit the zinc coat. Any material that performs this function will typically work as a preparative agent for electroless zinc deposition.

Any chemical agent that serves to remove the native oxide coating will typically act as a good preparative agent. Preferably, fluorides are used. Table 2 shows the solubilities in water of many different fluoride sources.

TABLE 2

Solubilities of Fluoride Preparative Agents under Ambient Conditions (Solubility in Water at or near 25° C. and at or near pH 7)

| Fluoride Source | Example Precursor | Solubility in Water (mole/L) |
|---|---|---|
| A) Simple Fluorides | Hydrofluoric acid | ∞ |
| | Ammonium fluoride | $2.7 \times 10^{1}$ |
| | Lithium fluoride | $1.04 \times 10^{-1}$ |
| | Sodium fluoride | $1.01 \times 10^{0}$ |
| | Potassium fluoride | $1.59 \times 10^{1}$ |
| | Potassium bifluoride | $5.25 \times 10^{0}$ |
| | Zinc fluoride | $1.57 \times 10^{-1}$ |
| | Aluminum fluoride | $6.6 \times 10^{-2}$ |
| B) Hexafluorozirconates | Ammonium fluorozirconate | $\sim 1 \times 10^{-1}$ |
| | Lithium hexafluorozirconate | $\sim 8 \times 10^{-2}$ |
| | Sodium hexafluorozirconate | $\sim 6 \times 10^{-2}$ |
| | Potassium hexafluorozirconate | $8.12 \times 10^{-2}$ |
| C) Hexafluorotitanates | Ammonium hexafluorotitanate | $\sim 1 \times 10^{-1}$ |
| | Lithium hexafluorotitanate | $\sim 5 \times 10^{-2}$ |
| | Sodium hexafluorotitanate | $\sim 1 \times 10^{-2}$ |
| | Potassium hexafluorotitanate | $6.0 \times 10^{-2}$ |
| D) Hexafluorosilicates | Ammonium hexafluorosilicate | $1.04 \times 10^{0}$ |
| | Lithium hexafluorosilicate | $3.8 \times 10^{0}$ |
| | Sodium hexafluorosilicate | $3.5 \times 10^{-2}$ |
| | Potassium hexafluorosilicate | $5.5 \times 10^{-3}$ |
| | Magnesium hexafluorosilicate | $3.9 \times 10^{0}$ |
| | Calcium hexafluorosilicate | $\sim 5 \times 10^{-1}$ |
| | Strontium hexafluorosilicate | |
| | Zinc hexafluorosilicate | $1.1 \times 10^{-1}$ |
| | Iron (II) hexafluorosilicate | $1.11 \times 10^{0}$ |
| | Iron (III) hexafluorosilicate | $4.19 \times 10^{0}$ |
| | | "soluble" |

TABLE 2-continued

Solubilities of Fluoride Preparative Agents under Ambient Conditions (Solubility in Water at or near 25° C. and at or near pH 7)

| Fluoride Source | Example Precursor | Solubility in Water (mole/L) |
|---|---|---|
| E) Hexafluoroaluminates | Ammonium fluoroaluminate | $5.3 \times 10^{-2}$ |
| | Lithium hexafluoroaluminate | $6.6 \times 10^{-3}$ |
| | Sodium hexafluoroaluminate | $2.9 \times 10^{-3}$ |
| | Potassium fluoroaluminate | $6.1 \times 10^{-3}$ |
| F) Tetrafluoroborates | Ammonium tetrafluoroborate | $2.4 \times 10^{0}$ |
| | Lithium tetrafluoroborate | $\sim 5 \times 10^{0}$ |
| | Sodium tetrafluoroborate | $9.8 \times 10^{0}$ |
| | Potassium tetrafluoroborate | $3.5 \times 10^{-2}$ |
| G) Hexafluorophosphates | Ammonium fluorophosphate | $\sim 1 \times 10^{0}$ |
| | Lithium hexafluorophosphate | $\sim 2 \times 10^{0}$ |
| | Sodium hexafluorophosphate | $5.6 \times 10^{0}$ |
| | Potassium fluorophosphate | $5.1 \times 10^{-1}$ |
| H) Hexafluoroantimonates | Ammonium fluoroantimonate | $4.7 \times 10^{0}$ |
| | Lithium hexafluoroantimonate | $\sim 1 \times 10^{0}$ |
| | Sodium hexafluoroantimonate | $4.97 \times 10^{0}$ |
| | Potassium fluoroantimonate | $3.7 \times 10^{0}$ |

Complex fluoride anions hexafluorozirconate ($ZrF_6^{-2}$), hexafluorotitanate ($TiF_6^{-2}$), and hexafluorosilicate ($SiF_6^{-2}$) are generally used as the preparative agent. The potassium, lithium, sodium, or ammonium salts of these anions work well.

Other complex fluorides [including, but not restricted to, fluoroaluminates (e.g. $AlF_6^{-3}$ or $AlF_4^{-1}$), fluoroborates (e.g. $BF_4^{-1}$), fluorophosphates (e.g. $PF_6^{-1}$), and fluoroantimonates (e.g. $SbF_6^{-1}$)] are also suitable fluoride sources, but these are less desirable fluoride sources either due to cost or due to a lower degree of oxide removal. Water-soluble potassium, sodium, lithium, or ammonium salts of these anions are typically used. Simple inorganic fluorides such as potassium fluoride (KF), potassium hydrogen fluoride ($KHF_2$), sodium fluoride (NaF), sodium hydrogen fluoride ($NaHF_2$), lithium fluoride (LiF), lithium hydrogen fluoride ($LiHF_2$), ammonium fluoride ($NH_4F$), ammonium hydrogen fluoride ($NH_4HF_2$), and even hydrofluoric acid solutions (HF) can also be used as a fluoride source, but these are less desirable due to observed pitting in the formed zinc coating with their use. By analogy, organic compounds that readily release acidic fluoride ions can also serve as adequate fluoride sources.

The maximum concentration of fluoride desirable for this process is typically the maximum solubility of the precursor salt in water, as is shown in Table 2. At concentrations higher than this, severe pitting of the zinc coating and perhaps minor pitting or "frosting" of the treated steel will be observed. Generally, the minimum concentration of the fluoride precursor is approximately 0.2 M of $F^-$. At concentrations lower than this, very little oxide removal (surface preparation) is typically observed.

Optimally, however, the concentration of available $F^-$ should be greater than or equal to about 0.3 M, but less than or equal to about 0.6 M. Lower concentrations typically result in insufficient preparation of the steel surface for this process. Higher concentrations typically result in "cratering" of the zinc coating, which will lower its corrosion resistance.

Acidic species such as sulfuric acid, hydrochloric acid, hydrobromic acid, hydriodic acid, phosphoric acid, phosphorous acid, boric acid, or carboxylic acids can also function as preparative agents ("activators") for these electroless zinc coating solutions. Care must be exercised, however, that the anions present with these acidic species do not result in premature precipitation of zinc from the coating solution. Likewise, reducible acids such as perchloric or nitric acids are less desirable due to consumption of the reducing agent ("fixer"). This may result in lower zinc deposition.

Another component in the composition is the complexing agent. Typical complexing agents for the electroless zinc deposition process are nitrogen-containing compounds such as ammonium, substituted ammonium, amines, and aromatic amines. These compounds are desirable because they raise the redox potential of the $Zn^{+2}$ ion in the precursor bath to the highest value. Other complexing agents, such as $CO_3^{-2}$, $OH^-$, $CN^-$, carboxylates, and halides, may result in lower redox potentials. This means that either stronger reducing agents should be used in the second step of the process or that less zinc may be deposited.

Phosphorus-containing compounds can also be used as a complexing agent because of the close structural and chemical similarity between nitrogen-containing compounds and phosphorus-containing compounds. Phosphorus-containing compounds such as phosphonium, substituted phosphonium, phosphines, and aromatic phosphines are expected to function in a similar manner to the nitrogen containing compounds.

The ratio of nitrogen- or phosphorus-containing complexing agent to the total zinc concentration in the first bath has a significant effect on the quality of the deposited zinc coating. Generally, the lowest desirable ratio of nitrogen- or phosphorus-containing complexing agent to zinc is about 0.5:1. Generally, the highest ratio is about 4:1. Ratios greater than or equal to about 2:1, but less than or equal to about 4:1 are typical. Ratios of complexing agent-to-zinc less than about 2:1 are less desirable because of insufficient complexing of the zinc in the first electroless plating solution.

The role of the complexing agents in the first bath is to form 'soft bonds' with the zinc ions in the solution. The formation of these 'soft bonds' (i.e. complexing) is a factor in the performance of the electroless zinc plating process. Without these complexing agents, much thinner or incompletely formed zinc coatings will result. This in turn will lower the corrosion resistance exhibited by these coatings.

The functionality of these complexing agents is founded in the electrochemical aspects of metal ions in solution. In order for a zinc ion dissolved in a solvent to be reduced to the elemental state, two electrons are donated from an outside source for each zinc ion. This results in a net electric potential that should be applied to each zinc ion in order to achieve this reduction. Generally, the "accepted" electric potential is about −0.76 V in acidic aqueous solution and about −1.25 V in basic aqueous solution for this reduction to the elemental state to occur.

While not being bound to theory, it is believed that the physics associated with this reduction process is lost, however, in these "accepted" values. These electric potential values represent the energy requirements necessary to force two electrons through the electrostatic barrier layer associated with any metal ion in any solvent. Because the net charge on each zinc ion is positive, these ions will preferentially attract negatively charged ions in that solvent. In pure water, these negatively charged ions are $OH^-$ ions, which are formed from the dissociation of water molecules. The electric potential associated with the "accepted" values therefore are the energy requirements associated with driving two electrons for each zinc ion through the electrostatic barrier layer of $OH^-$ ions that are loosely attracted to each zinc ion. Because acidic aqueous solutions contain far less $OH^-$ ions than basic aqueous solutions, the electrostatic barrier layer of $OH^-$ ions clustered around each zinc ion is far smaller in acidic aqueous solution. This is represented by the much smaller energy requirements desirable to force the two electrons through the electrostatic barrier layer in acidic (0.76 V) than in basic (1.25 V) aqueous conditions.

Other ions can replace $OH^-$ ions in the electrostatic barrier layer around zinc ions. Depending on the speciation of these other ions (complexing ligands), the electron shells of the zinc ions can be stretched or compressed, which further influences the ability for the zinc ions to accept electrons. Table 3 shows the energy requirements required to force two electrons through electrostatic barrier films of varying compositions under basic aqueous conditions. As can be seen in Table 3, these energy differences are significant. The "accepted" literature values for the reduction of zinc can therefore be adjusted significantly merely by complexing the dissolved zinc ions with ligands of varying composition.

TABLE 3

Energy Requirements to Reduce Zinc Ions in Basic Aqueous Solutions as a Function of Complexing Ligand

| Complexing Ligand | Redox Potential (V) for Zinc Ions |
|---|---|
| Ammonia ($NH_3$) | 1.04 |
| Carbonate ($CO_3^{-2}$) | 1.06 |
| Hydroxide ($OH^-$) | 1.25 |
| Cyanide ($CN^-$) | 1.34 |
| Sulfide ($S^{-2}$) | 1.44 |

As can be seen from Table 3, ammonia (and ligands closely related to ammonia) results in the lowest energy requirements for reduction of zinc to the elemental state. That is because ammonia and ligands related to ammonia are not negatively charged (which would repel electrons) and do not form compounds with zinc. The second point is significant because the 'soft bonds' formed between zinc ions and ammonia are not true chemical bonds wherein electrons from both species (cation and anion) are shared; rather, the electron shells associated with the zinc ions are stretched by the 'soft bonds' with ammonia. This further facilitates acceptance of incoming electrons.

The complexing agents described in the present invention lower the energy requirements to reduce zinc ions to elemental zinc. The characteristics of the zinc plate obtained with or without these complexing agents differ substantially. With these complexing agents, a measurable thickness of zinc can be obtained. Without these complexing agents, or with very low concentrations of complexing agents, little to no zinc can be obtained.

Nitrogen-containing compounds such as ammonium, substituted ammonium, amines, aromatic amines, and a few other nitrogen-containing compounds are the desirable complexing agents for the electroless zinc deposition process. Ammonium is the lowest cost complexing agent for the electroless zinc deposition process, and ammonium salts typically are appreciably soluble in water. Table 4 shows the solubility in water of some conventional ammonium compounds.

TABLE 4

Maximum Solubility of Some Ammonium Precursors (moles/liter $NH_4^+$ at 20 to 30° C.)

| Ammonium Source | Solubility | Comments |
|---|---|---|
| Ammonium lactate | ∞ | ammonium source |
| Ammonium fluoride | 27.0 | ammonium source |

TABLE 4-continued

Maximum Solubility of Some Ammonium Precursors (moles/liter $NH_4^+$ at 20 to 30° C.)

| Ammonium Source | Solubility | Comments |
|---|---|---|
| Ammonium acetate | 19.2 | ammonium source |
| Ammonium formate | 16.1 | ammonium source |
| Ammonium nitrate | 14.7 | Less desirable ammonium source due to reducible anion |
| Ammonium sulfamate | 14.5 | ammonium source |
| Ammonium iodide | 12.3 | ammonium source |
| Ammonium propionate | ~12.0 | ammonium source |
| Ammonium bromide | 9.9 | ammonium source |
| Ammonium carbonate | 8.8 | ammonium source |
| Ammonium chloride | 7.7 | ammonium source |
| Ammonium salicylate | 7.2 | ammonium source |
| Ammonium sulfate | 5.3 | ammonium source |
| Ammonium citrate | 4.4 | ammonium source |
| Ammonium tartrate | 3.1 | Less desirable ammonium source due to low solubility |
| Ammonium fluoborate | 2.4 | Less desirable ammonium source due to low solubility |
| Ammonium bicarbonate | 1.5 | Less desirable ammonium source due to low solubility |
| Ammonium phosphate | 1.2 | Less desirable ammonium source due to low solubility |

As with the zinc sources, ammonium precursors that contain reducible anions (e.g., ammonium nitrate) are less desirable than other ammonium sources because the oxidizing anion will preferentially react with the subsequently-applied reducing agent, resulting in less zinc being deposited, and hence lower corrosion protection.

Substituted ammonium compounds ($NR_4^+$) where R represents an alkyl, aromatic, or acyclic organic constituent of size $C_1$ (methyl) through $C_{10}$ (decyl) can also be used as complexing agents. The organic constituents on the substituted ammonium ion do not have to be of the same molecular size or geometry. Thus, for example, methyltriethylammonium [$NMeEt_3^+$] is an acceptable complexing agent. Organic constituents larger than $C_{10}$ are less desirable because they are less economical, and the solubility of these larger substituted ammonium ions in water (the preferred solvent) decreases rapidly. Fluorides and lactates of the substituted ammonium compounds offer the highest solubility in water, although chlorides, bromides, iodides, acetates, formates, and propionates also offer desirable solubilities in water.

Amines and aromatic amines can also be used as complexing agents. These materials can function under both aqueous and nonaqueous solvent conditions. For example, some amines are highly soluble in water yet insoluble in nonaqueous solvents, whereas others exhibit very low aqueous solubilities and high organic solvent solubilities. In this way, electroless zinc deposition can be achieved using a number of different solvent systems.

The amine complexing agents can be divided into two general categories: aliphatic amines, and aromatic amines (heterocyclics). Each of these two general categories can be further divided into subcategories. For example, aliphatic amines can include: a) monoamines, b) diamines, c) triamines, d) tetramines, e) pentamines, and f) hexamines. Aromatic amines can be either five-membered rings or six-membered rings. Each of these aromatic amine (heterocyclic) categories can contain anywhere from 1 to 4 nitrogen atoms within the ring, available for complexing to the zinc ions. Useful examples for each subcategory are listed below.

Examples of monoamines include, but are not limited to: ammonia, ethylamine, octylamine, phenylamine, cyclohexylamine, diethylamine, dioctylamine, diphenylamine, dicyclohexylamine, azetidine, hexamethylenetetramine, aziridine, azacyclohexane, azepine, pyrrolidine, benzopyrrolidine, dibenzopyrrolidine, naphthopyrrolidine, piperidine, benzopiperidine, dibenzopiperidine, naphthopiperidine, aminonorbornane, adamantanamine, aniline, benzylamine, toluidine, phenethylamine, xylidine, cumidine, and naphthylamine. Ammonia is included as a monoamine with no organic groups attached. Ammonia is notorious for its ability to complex with zinc ions in water. For example, a 30 weight percent solution of ammonia in water can easily dissolve upwards to 50 weight percent zinc nitrate due to the formation of ammoniated zinc ions $[Zn(NH_3)_{4-6}]^{2+}$ in solution. Due to its low cost, ammonia is a highly desirable complexing agent for this process.

Examples of diamines include, but are not limited to: hydrazine, methanediamine, ethylenediamine (1,2-ethanediamine, en), trimethylenediamine (1,3-propanediamine, tn), putrescine (1,4-butanediamine, bn), cadaverine (1,5-pentanediamine), hexamethylenediamine (1,6-hexanediamine), 2,3-diaminobutane (sbn), stilbenediamine (1,2-diphenyl-1,2-ethanediamine, stien), cyclohexane-1,2-diamine (chxn), cyclopentane-1,2-diamine, 1,3-diazacyclopentane, 1,3-diazacyclohexane, piperazine, benzopiperazine, dibenzopiperazine, naphthopiperazine, diazepine, and 1,2-diaminobenzene (dab).

Examples of triamines include, but are not limited to: N-(2-aminoethyl)-1,2-ethanediamine (dien, 2,2-tri); N-(2-aminoethyl)-1,3-propanediamine (2,3-tri); N-(3-aminopropyl)-1,3-propanediamine (3,3-tri, dpt); N-(3-aminopropyl)-1,4-butanediamine (3,4-tri, spermidine); N-(2-aminoethyl)-1,4-butanediamine (2,4-tri); N-(6-hexyl)-1,6-hexanediamine (6,6-tri); 1,3,5-triaminocyclohexane (tach); 2-(aminomethyl)-1,3-propanediamine (tamm); 2-(aminomethyl)-2-methyl-1,3-propanediamine (tame); 2-(aminomethyl)-2-ethyl-1,3-propanediamine (tamp); 1,2,3-triaminopropane (tap); 2,4-(2-aminoethyl)azetidine; di(2-aminobenzyl)amine; hexahydro-1,3,5-triazine; and hexahydro-2,4,6-trimethyl-1,3,5-triazine.

Examples of tetramines include, but are not limited to: N,N'-(2-aminoethyl)-1,2-ethanediamine (2,2,2-tet, trien); N,N'-(2-aminoethyl)-1,3-propanediamine (2,3,2-tet, entnen); N,N'-(3-aminopropyl)-1,2-ethanediamine (3,2,3-tet, tnentn); N-(2-aminoethyl)-N'-(3-aminopropyl)-1,2-ethanediamine (2,2,3-tet); N-(2-aminoethyl)-N'-(3-aminopropyl)-1,3-propanediamine (3,3,2-tet); N,N'-(3-aminopropyl)-1,3-propanediamine (3,3,3-tet); N,N'-(3-aminopropyl)-1,4-butanediamine (3,4,3-tet, spermine); tri(aminomethyl)amine (tren); tri(2-aminoethyl)amine (trtn); tri(3-aminopropyl)amine (trbn); 2,2-aminomethyl-1,3-propanediamine (tam); 1,2,3,4-tetraminobutane (tab); N,N'-(2-aminophenyl)-1,2-ethanediamine; and N,N'-(2-aminophenyl)-1,3-propanediamine.

Examples of pentamines include, but are not limited to: N-[N-(2-aminoethyl)-2-aminoethyl]-N'-(2-aminoethyl)-1,2-ethanediamine (2,2,2,2-pent, tetren); N-[N-(3-aminopropyl)-2-aminoethyl]-N'-(3-aminopropyl)-1,2-ethanediamine (3,2,2,3-pent); N-[N-(3-aminopropyl)-3-aminopropyl]-N'-(3-aminopropyl)-1,3-propanediamine (3,3,3,3-pent, caldopentamine); N-[N-(2-aminobenzyl)-2-aminoethyl]-N'-(2-aminopropyl)-1,2-ethanediamine; N-[N-(2-aminoethyl)-2-aminoethyl]-N,N-(2-aminoethyl)amine (trenen); and N-[N-(2-aminopropyl)-2-aminoethyl]-N,N-(2-aminoethyl)amine (4-Me-trenen).

Examples of hexamines include, but are not limited to: N,N'-[N-(2-aminoethyl)-2-aminoethyl]-1,2-ethanediamine (2,2,2,2,2-hex, linpen); N,N'-[N-(2-aminoethyl)-3-aminopropyl]-1,2-ethanediamine (2,3,2,3,2-hex); N,N,N',N'-(2-aminoethyl)-1,2-ethanediamine (penten, ten); N,N,N',N'-(2-aminoethyl)-1-methyl-1,2-ethanediamine (tpn, R-5-Me-penten); N,N,N',N'-(2-aminoethyl)-1,3-propanediamine (ttn); N,N,N',N'-(2-aminoethyl)-1,4-butanediamine (tbn); N,N,N',N'-(2-aminoethyl)-1,3-dimethyl-1,3-propanediamine (R,R-tptn, R,S-tptn); N-(2-aminoethyl)-2,2-[N-(2-aminoethyl)aminomethyl-1-propaneamine (sen); and N-(3-aminopropyl)-2,2-[N-(3-aminopropyl) aminomethyl-1-propaneamine (stn).

Examples of 5-membered heterocyclic rings that contain one nitrogen atom include, but are not limited to: 1-pyrroline, 2-pyrroline, 3-pyrroline, pyrrole, oxazole, isoxazole, thiazole, isothiazole, azaphosphole, benzopyrroline, benzopyrrole (indole), benzoxazole, benzisoxazole, benzothiazole, benzisothiazole, benzazaphosphole, dibenzopyrroline, dibenzopyrrole (carbazole), dibenzoxazole, dibenzisoxazole, dibenzothiazole, dibenzisothiazole, naphthopyrroline, naphthopyrrole, naphthoxazole, naphthisoxazole, naphthothiazole, naphthisothiazole, and naphthazaphosphole.

Examples of 5-membered heterocyclic rings that contain two nitrogen atoms include, but are not limited to: pyrazoline, imidazoline, imidazole, pyrazole, oxadiazole, thiadiazole, diazaphosphole, benzopyrazoline, benzimidazoline, benzimidazole (azindole), benzopyrazole (indazole), benzothiadiazole (piazthiole), benzoxadiazole (benzofurazan), naphthopyrazoline, naphthimidazoline, naphthimidazole, naphthopyrazole, naphthoxadiazole, and naphthothiadiazole.

Examples of 5-membered heterocyclic rings that contain three nitrogen atoms include, but are not limited to: triazole, oxatriazole, thiatriazole, benzotriazole, and naphthotriazole.

Examples of 5-membered heterocyclic rings that contain four nitrogen atoms include, but are not limited to: tetrazole.

Examples of 6-membered heterocyclic rings that contain one nitrogen atom include, but are not limited to: pyridine, picoline, lutidine, γ-collidine, oxazine, thiazine, azaphosphorin, quinoline, isoquinoline, benzoxazine, benzothiazine, benzazaphosphorin, acridine, phenanthridine, phenothiazine (dibenzothiazine), dibenzoxazine, dibenzazaphosphorin, benzoquinoline (naphthopyridine), naphthoxazine, naphthothiazine, and naphthazaphosphorin.

Examples of 6-membered heterocyclic rings that contain two nitrogen atoms include, but are not limited to: pyrazine, pyridazine, pyrimidine, oxadiazine, thiadiazine, diazaphosphorin, quinoxaline (benzopyrazine), cinnoline (benzo[c]pyridazine), quinazoline (benzopyrimidine), phthalazine (benzo[d]pyridazine), benzoxadiazine, benzothiadiazine, phenazine (dibenzopyrazine), dibenzopyridazine, naphthopyrazine, naphthopyridazine, naphthopyrimidine, naphthoxadiazine, and naphthothiadiazine.

Examples of 6-membered heterocyclic rings that contain three nitrogen atoms include, but are not limited to: 1,3,5-triazine, 1,2,3-triazine, benzo-1,2,3-triazine, naphtho-1,2,3-triazine, oxatriazine, thiatriazine, melamine, and cyanuric acid.

Examples of 6-membered heterocyclic rings that contain four nitrogen atoms include, but are not limited to: tetrazine.

Each of these subcategories exhibit slightly different performance characteristics from each other when used in the electroless zinc deposition process, hence their separation from one another. For example, higher complexing agent-to-zinc ratios are desirable for monoamines than for tetramines, because each of the monoamine ligands contains only one bonding site, whereas the tetraamine ligands contain four. This can affect the concentration of complexing agent that may be placed into solution for each subcategory of amine.

Combinations of aliphatic and aromatic amines can also be used effectively as complexing agents. Five- or six-membered heterocyclic rings containing nitrogen bonding sites can have attached aliphatic nitrogen-containing groups that can also complex with the $Zn^{+2}$ ion. Likewise, complexing agents containing two or more 5- or 6-membered heterocyclic rings can be complexed with the $Zn^{+2}$ ion. In this way, redox and solubility tailoring of the $Zn^{+2}$ ion can be achieved.

Examples of 5-membered heterocyclic rings that contain one nitrogen atom with at least one additional nitrogen atom binding site not contained in a ring include, but are not limited to: 2-(aminomethyl)-3-pyrroline; 2,5-(aminomethyl)-3-pyrroline; 2-(aminomethyl)pyrrole; 2,5-(aminomethyl)pyrrole; 3-(aminomethyl)isoxazole; 2-(aminomethyl)thiazole; 3-(aminomethyl)isothiazole; 2-(aminomethyl)indole; 2-aminobenzoxazole; 2-aminobenzothiazole (abt); 1,8-diaminocarbazole; 2-amino-6-methylbenzothiazole (amebt); and 2-amino-6-methoxybenzothiazole (ameobt).

Examples of 5-membered heterocyclic rings that contain two nitrogen atoms with at least one additional nitrogen atom binding site not contained in a ring include, but are not limited to: 2-aminoimidazoline; 1-(3-aminopropyl) imidazoline; 2-aminoimidazole; 1-(3-aminopropyl) imidazole; 4-(2-aminoethyl)imidazole [histamine]; 1-alkyl-4-(2-aminoethyl)imidazole; 3-(2-aminoethyl)pyrazole; 3,5-(2-aminoethyl)pyrazole; 1-(aminomethyl)pyrazole; 2-aminobenzimidazole; 7-(2-aminoethyl)benzimidazole; 1-(3-aminopropyl)benzimidazole; 3-(2-aminoethyl) indazole; 3,7-(2-aminoethyl)indazole; 1-(aminomethyl) indazole; 7-aminobenzothiadiazole; 4-(2-aminoethyl) benzothiadiazole; 7-aminobenzoxadiazole; 4-(2-aminoethyl)benzoxadiazole; ethylenediaminetetra(1-pyrazolylmethane) [edtp]; methylenenitrilotris(2-(1-methyl) benzimidazole) [mntb][tris(1-methyl-2-benzimidazolylmethane)amine]; bis(alkyl-1-pyrazolylmethane)amine; bis(alkyl-2-(1-pyrazolyl)ethane) amine; bis(N,N-(2-benzimidazolyl)-2-aminoethane)(2-benzimidazolylmethane)amine; bis(1-(3,5-dimethyl) pyrazolylmethane)phenylamine; and tris(2-(1-(3,5-dimethyl)pyrazolyl)ethane)amine.

Examples of 5-membered heterocyclic rings that contain three nitrogen atoms with at least one additional nitrogen atom binding site not contained in a ring include, but are not limited to: 3-amino-1,2,4-triazole (ata); 3,5-diamino-1,2,4-triazole (dat); 5-amino-1,2,4-triazole; 3-(2-aminoethyl)-1,2,4-triazole; 5-(2-aminoethyl)-1,2,4-triazole; 3,5-(2-aminoethyl)-1,2,4-triazole; 1-(aminomethyl)-1,2,4-triazole; 3,5-(aminomethyl)-4-amino-1,2,4-triazole; 4-(2-aminoethyl)-1,2,3-triazole; 5-(2-aminoethyl)-1,2,3-triazole; 7-aminobenzotriazole; 1-(aminomethyl)-1,2,3-triazole; 1-(2-aminoethyl)-1,2,3-triazole; 4-(3-aminopropyl) benzotriazole; and N-(benzotriazolylalkyl)amine.

Examples of 5-membered heterocyclic rings that contain four nitrogen atoms with at least one additional nitrogen atom binding site not contained in a ring include, but are not limited to: 5-(2-aminoethyl)-1H-tetrazole; 1-(aminomethyl)-1H-tetrazole; and 1-(2-aminoethyl)-1H-tetrazole.

Examples of 6-membered heterocyclic rings that contain one nitrogen atom with at least one additional nitrogen atom binding site not contained in a ring include, but are not limited to: 2-aminopyridine; 2,6-diaminopyridine; 2-(aminomethyl)pyridine; 2,6-(aminomethyl)pyridine; 2,6-(aminoethyl)pyridine; 2-amino-4-picoline; 2,6-diamino-4-picoline; 2-amino-3,5-lutidine; 2-aminoquinoline; 8-aminoquinoline; 2-aminoisoquinoline; acriflavine; 4-aminophenanthridine; 4,5-(aminomethyl)phenothiazine; 4,5-(aminomethyl)dibenzoxazine; 10-amino-7,8-benzoquinoline; bis(2-pyridylmethane)amine; tris(2-pyridyl)amine; bis(4-(2-pyridyl)-3-azabutane)amine; bis(N,N-(2-(2-pyridyl)ethane)aminomethane)amine; and 4-(N,N-dialkylaminomethyl)morpholine.

Examples of 6-membered heterocyclic rings that contain two nitrogen atoms with at least one additional nitrogen atom binding site not contained in a ring include, but are not limited to: 2-aminopyrazine; 2,6-diaminopyrazine; 2-(aminomethyl)pyrazine; 2,6-(aminomethyl)pyrazine; 3-(aminomethyl)pyridazine; 3,6-(aminomethyl)pyridazine; 3,6-(2-aminoethyl)pyridazine; 1-aminopyridazine; 1-(aminomethyl)pyridazine; 2-aminopyrimidine; 1-(2-aminoethyl)pyrimidine; 2-aminoquinoxaline; 2,3-diaminoquinoxaline; 2-aminocinnoline; 3-aminocinnoline; 3-(2-aminoethyl)cinnoline; 3,8-(2-aminoethyl)cinnoline; 2-aminoquinazoline; 1-(2-aminoethyl)quinazoline; 1-aminophthalazine; 1,4-(2-aminoethyl)phthalazine; and 1,8-(aminomethyl)phenazine.

Examples of 6-membered heterocyclic rings that contain three nitrogen atoms with at least one additional nitrogen atom binding site not contained in a ring include, but are not limited to: 2-amino-1,3,5-triazine; 2-(aminomethyl)-1,3,5-triazine; 2,6-(aminomethyl)-1,3,5-triazine; 1-(3-aminopropyl)-1,3,5-triazine; 1,5-(3-aminopropyl)-1,3,5-triazine, and polymelamines.

Examples of 6-membered heterocyclic rings that contain four nitrogen atoms with at least one additional nitrogen atom binding site not contained in a ring include, but are not limited to: 3,6-(2-aminoethyl)-1,2,4,5-tetrazine; 3,6-(1,3-diamino-2-propyl)-1,2,4,5-tetrazine; and 4,6-(aminomethyl)-1,2,3,5-tetrazine.

Examples of 5-membered heterocyclic rings that contain one nitrogen atom with at least one additional nitrogen atom binding site contained in a ring include, but are not limited to: 2,2'-bi-3-pyrroline; 2,2'-bi-2-pyrroline; 2,2'-bi-1-pyrroline; 2,2'-bipyrrole; 2,2',2"-tripyrrole; 3,3'-biisoxazole; 2,2'-bioxazole; 3,3'-biisothiazole; 2,2'-bithiazole; 2,2'-biindole; 2,2'-bibenzoxazole; and 2,2'-bibenzothiazole.

Examples of 5-membered heterocyclic rings that contain two nitrogen atoms with at least one additional nitrogen atom binding site contained in a ring include, but are not limited to: 2,2'-bi-2-imidazoline [2,2'-bi-2-imidazolinyl][bimd]; 2,2'-biimidazole [2,2'-biimidazolyl][biim$H_2$]; 5,5'-bipyrazole; 3,3'-bipyrazole; 4,4'-bipyrazole [4,4'-bipyrazolyl][bpz]; 2,2'-bioxadiazole; 2,2'-bithiadiazole; 2,2'-bibenzimidazole; 7,7'-biindazole; 5,5'-bibenzofurazan; 5,5'-bibenzothiadiazole; bis-1,2-(2-benzimidazole)ethane; bis(2-benzimidazole)methane; 1,2-(2-imidazolyl)benzene; 2-(2-thiazolyl)benzimidazole; 2-(2-imidazolyl)benzimidazole.

Examples of 5-membered heterocyclic rings that contain three nitrogen atoms with at least one additional nitrogen atom binding site contained in a ring include, but are not limited to: 5,5'-bi-1,2,4-triazole [btrz]; 3,3'-bi-1,2,4-triazole; 1,1'-bi-1,2,4-triazole; 1,1'-bi-1,2,3-triazole; 5,5'-bi-1,2,3-triazole; 7,7'-bibenzotriazole; 1,1'-bibenzotriazole; and bis(pyridyl)aminotriazole (pat).

Examples of 5-membered heterocyclic rings that contain four nitrogen atoms with at least one additional nitrogen atom binding site contained in a ring include, but are not limited to: 5,5'-bi-1H-tetrazole; and 1,1'-bi-1H-tetrazole.

Examples of 6-membered heterocyclic rings that contain one nitrogen atom with at least one additional nitrogen atom binding site contained in a ring include, but are not limited to: 2,2'-bipyridine [bipy]; 2,2',2"-tripyridine [terpyridine][terpy]; 2,2',2",2'"-tetrapy [tetrapy]; 6,6'-bi-2-picoline; 6,6'-bi-3-picoline; 6,6'-bi-4-picoline; 6,6'-bi-2,3-lutidine; 6,6'-bi-2,4-lutidine; 6,6'-bi-3,4-lutidine; 6,6'-bi-2,3,4-collidine; 2,2'-biquinoline; 2,2'-biisoquinoline; 3,3'-bibenzoxazine; 3,3'-bibenzothiazine; 1,10-phenanthroline [phen]; 1,8-naphthyridine; bis-1,2-(6-(2,2'-bipyridyl))ethane; bis-1,3-(6-(2,2'-bipyridyl))propane; 3,5-bis(3-pyridyl)pyrazole; 3,5-bis(2-pyridyl)triazole; 1,3-bis(2-pyridyl)-1,3,5-triazine; 1,3-bis(2-pyridyl)-5-(3-pyridyl)-1,3,5-triazine; 2,7-(N,N'-di-2-pyridyl)diaminobenzopyrroline; 2,7-(N,N'-di-2-pyridyl)diaminophthalazine; 2,6-di-(2-benzothiazolyl)pyridine; triazolopyrimidine; 2-(2-pyridyl)imidazoline; 7-azaindole; 1-(2-pyridyl)pyrazole; (1-imidazolyl)(2-pyridyl)methane; 4,5-bis(N,N'-(2-(2-pyridyl)ethyl)iminomethyl)imidazole; bathophenanthroline.

Examples of 6-membered heterocyclic rings that contain two nitrogen atoms with at least one additional nitrogen atom binding site contained in a ring include, but are not limited to: 2,2'-bipyrazine; 2,2',2"-tripyrazine; 6,6'-bipyridazine; bis(3-pyridazinyl)methane; 1,2-bis(3-pyridazinyl)ethane; 2,2'-bipyrimidine; 2,2'-biquinoxaline; 8,8'-biquinoxaline; bis(3-cinnolinyl)methane; bis(3-cinnolinyl)ethane; 8,8'-bicinnoline; 2,2'-biquinazoline; 4,4'-biquinazoline; 8,8'-biquinazoline; 2,2'-biphthalazine; 1,1'-biphthalazine; 2-(2-pyridyl)benzimidazole; 8-azapurine; purine; adenine; guanine; hypoxanthine; 2,6-bis(N,N'-(2-(4-imidazolyl)ethyl)iminomethyl)pyridine; and 2-(N-(2-(4-imidazolyl)ethyl)iminomethyl)pyridine.

Examples of 6-membered heterocyclic rings that contain three nitrogen atoms with at least one additional nitrogen atom binding site contained in a ring include, but are not limited to: 2,2'-bi-1,3,5-triazine; 2,2',2"-tri-1,3,5-triazine; 4,4'-bi-1,2,3-triazine; and 4,4'-bibenzo-1,2,3-triazine; 2,4,6-tris(2-pyridyl)-1,3,5-triazine; and benzimidazotriazines.

Examples of 6-membered heterocyclic rings that contain four nitrogen atoms with at least one additional nitrogen atom binding site contained in a ring include, but are not limited to: 3,3'-bi-1,2,4,5-tetrazine; and 4,4'-bi-1,2,3,5-tetrazine.

Lastly, other nitrogen-containing compounds can effectively be used as complexing agents for the electroless deposition of zinc. These include but are not limited to: 1) porphyrins; 2) amidines and diamidines; 3) guanidines, diguanidines, and polyguanidines; 4) biguanides (imidodicarbonimidic diamides), biguanidines, imidotricarbonimidic diamides, imidotetracarbonimidic diamides, dibiguanides, bis(biguanidines), polybiguanides, and poly(biguanidines); 5) imidosulfamides, diimidosulfamides, bis(imidosulfamides), bis(diimidosulfamides), poly(imidosulfamides), and poly(diimidosulfamides); 6) phosphoramidimidic triamides, bis(phosphoramidimidic triamides), and poly(phosphoramidimidic triamides); 7) phosphoramidimidic acid, phosphorodiamidimidic acid, bis(phosphoramidimidic acid), bis(phosphorodiamidimidic acid), poly(phosphoramidimidic acid), poly(phosphorodiamidimidic acid), and derivatives thereof; 8) phosphonimidic diamides, bis(phosphonimidic diamides), and poly(phosphonimidic diamides); 9) phosphonamidimidic acid, bis(phosphonamidimidic acid), poly(phosphonamidimidic acid), and derivatives thereof; 10) azo compounds, especially with amino, imino, oximo, diazeno, or hydrazido substitution at the ortho-position; 11) formazan compounds, especially with amino, imino, oximo, diazeno, or hydrazido substitution at the ortho-position; 12) azine compounds (including ketazines), especially with amino, imino, oximo, diazeno, or hydrazido substitution at the ortho-position; and 13) Schiff Bases with one, two, or three imine groups, with or without amino, imino, oximo, diazeno, or hydrazido substitution at the ortho-position; 14) hydrazones; and 15) hydramides. Each of these useful complexing agents is described below.

Porphyrins are cyclic complexing compounds with four nitrogen binding sites where the $Zn^{+2}$ ion sits within the central cavity formed by these nitrogen bonding sites. Zinc-chlorophyll is a primary example of these compounds. Amidines and diamidines have the general formula R'—NH—C(—R)═N—R", where R, R', and R" represent H or any organic functional group wherein the number of carbon atoms ranges from 0 to 12. Biguanides and biguanidines are desirable complexing agents for $Zn^{+2}$ for this application, because of the much smaller redox potential energy for $Zn^{+2}$ reduction compared to other complexing agents. Biguanides have the general formula RR'—N—C(═NH)—NR"—C(═NH)—NR'"R"", whereas biguanidines have the general formula RR'—N—C(═NH)—NR"—NH—C(═NH)—NR'"R"", where R, R', R", R'", and R"" repr H, $NH_2$, or any organic functional group wherein the number of carbon atoms ranges from 0 to 16.

Amine and imine derivatives of sulfonic and phosphoric acids may also be used as complexing agents for $Zn^{+2}$ for this application. Imidosulfamides and diimidosulfamides are desirable sulfonic acid derivatives. The general formulas RR'—N—S(═NH)(═O)—OR" or RR'—N—S(═NH)(═O)—N—R"R'" for imidosulfamides, and RR'—N—S(═NH)(═NH)—OR" or RR'—N—S(═NH)(═NH)—N—R"R'" for diimidosulfamides describe these compounds, where R, R', R", and R'" represent H, $NH_2$, or any organic functional group wherein the number of carbon atoms ranges from 0 to 12. Likewise, phosphoramidimidic triamides, with general formula (NH═)P(—NRR')(—NR"R'")(—NR""R""), where R, R', R", R'", R"", and R"" represent H, $NH_2$, or any organic functional group wherein the number of carbon atoms ranges from 0 to 12, are desirable nitrogen-containing complexing agents for this application. Phosphoramidimidic acids, phosphorodiamidimidic acids, and their derivatives, are useful nitrogen-containing complexing agents for the electroless deposition of zinc. The general formulas (NH═)P(—NRR')$(OH)_2$ for phosphoramidimidic acid, and (NH═)P(—NRR')(—NR"R'")(OH) for phosphorodiamidimidic acid, where R, R', R", and R'" represent H, $NH_2$, or any organic functional group wherein the number of carbon atoms ranges from 0 to 12, represent these compounds.

Azo compounds, Schiff Bases, hydrazones, formazans, triazenes, and azines (the termazine includes ketazines) are useful complexing agents for $Zn^{+2}$ for this application, because these complexing agents minimize the amount of potential energy required to reduce the $Zn^{+2}$ ion in solution to $Zn^0$. Moreover, if these ligands have nitrogen containing substitution at the ortho-position on one or both rings adjoining the aforementioned group, then reduction of $Zn^{+2}$ to the elemental state is further facilitated. Foremost among these nitrogen-containing substitutes at the ortho-position are amino, imino, oximo, diazeno, or hydrazido groups. The general formula for azo compounds is R—N═N—R', where R, and R' represent H or any organic functional group wherein the number of carbon atoms ranges from 0 to 16. The general formula for Schiff Bases is RR'C═N—R", where R, R', and R" represent H, or any organic functional group wherein the number of carbon atoms ranges from 0 to 16. Hydrazones are best represented by the formula R—NH—N═R', where R and R' represent H or any organic functional group wherein the number of carbon atoms ranges from 0 to 16. Triazenes are represented by the general formula R—N═N—NH—R', where R and R' represent H or any organic functional group wherein the number of carbon atoms ranges from 0 to 16. Similarly, formazans are best represented by the formula R—N═N—CR'═N—NR"R'", where R, R', R", and R'" represent H, or any organic functional group wherein the number of carbon atoms ranges from 0 to 16. Lastly, azines (including ketazines) are described by the general formula RR'C═N—N═CR"R'" [or RR'C═N—NR"R'" (for ketazines)], where R, R', R", and R'" represent H, or any organic functional group wherein the number of carbon atoms ranges from 0 to 16.

Guanidines are nitrogen-containing ligands that are less desirable as complexing agents, because the redox potential energy will be higher than for other nitrogen ligands, meaning that reduction of zinc to the elemental state will be more difficult using these complexing agents. Guanidines have the general formula RR'—N—C(═NH)NR"R'", where R, R', R", and R'" represent H or any organic functional group wherein the number of carbon atoms ranges from 0 to 12. Likewise, phosphonimidic diamides are less desirable because reduction of $Zn^{+2}$ to $Zn^0$ is a bit more difficult using these complexing agents. (It is still much better than if no complexing agent were used.) The general formula for these ligands is (NH═)PR""(—NRR')(—NR"R'"), where R, R', R", R'", and R"" represent H or any organic functional group wherein the number of carbon atoms ranges from 0 to 12. Similarly, phosphonamidimidic acid and derivatives thereof are less desirable for the same reasons. The general formula for phosphonamidimidic acid is (NH═)PR'"(—NRR')(—OR"), where R, R', R", and R'" represent H or any organic functional group wherein the number of carbon atoms ranges from 0 to 12. Hydramides are also less desirable complexing agents. The general formula for hydramides is R—CH═N—CHR'—N═CHR", where R, R', and R" represent H, or any organic functional group wherein the number of carbon atoms ranges from 0 to 12.

Examples of porphyrins include, but are not limited to: porphyrins (including tetraphenylporphine (tpp); "picket fence" porphyrins, "picket tail" porphyrins, "bispocket" porphyrins, "capped" porphyrins, cyclophane porphyrins, "pagoda" porphyrins, "pocket" porphyrins, "pocket tail" porphyrins, cofacial diporphyrins, "strapped" porphyrins, "hanging base" porphyrins, bridged porphyrins, chelated mesoporphyrins, homoporphyrins, chlorophylls, and pheophytins); porphodimethanes; porphyrinogens; chlorins; bacteriochlorins; isobacteriochlorins; corroles; corrins and corrinoids; didehydrocorrins; tetradehydrocorrins; hexadehydrocorrins; octadehydrocorrins; tetraoxazoles; tetraisooxazoles; tetrathiazoles; tetraisothiazoles; tetraazaphospholes; tetraimidazoles; tetrapyrazoles; tetraoxadiazoles; tetrathiadiazoles; tetradiazaphospholes; tetratriazoles; tetraoxatriazoles; and tetrathiatriazoles.

Examples of amidines and diamidines include, but are not limited to: N,N'-dimethylformamidine; N,N'-diethylformamidine; N,N'-diisopropylformamidine; N,N'-dibutylformamidine; N,N'-diphenylformamidine; N,N'-dibenzylformamidine; N,N'-dinaphthylformamidine; N,N'-dicyclohexylformamidine; N,N'-dinorbornylformamidine; N,N'-diadamantylformamidine; N,N'-dianthraquinonylformamidine; N,N'-dimethylacetamidine; N,N'-diethylacetamidine; N,N'-diisopropylacetamidine; N,N'-dibutylacetamidine; N,N'-diphenylacetamidine; N,N'-dibenzylacetamidine; N,N'-dinaphthylacetamidine; N,N'- dicyclohexylacetamidine; N,N'-dinorbornylacetamidine; N,N'-diadamantylacetamidine; N,N'-dimethylbenzamidine; N,N'-diethylbenzamidine; N,N'-diisopropylbenzamidine; N,N'-dibutylbenzamidine; N,N'-diphenylbenzamidine; N,N'-dibenzylbenzamidine; N,N'-dinaphthylbenzamidine; N,N'-dicyclohexylbenzamidine; N,N'-dinorbornylbenzamidine; N,N'-diadamantylbenzamidine; N,N'-dimethyltoluamidine; N,N'-diethyltoluamidine; N,N'-diisopropyltoluamidine; N,N'-dibutyltoluamidine; N,N'-diphenyltoluamidine; N,N'-dibenzyltoluamidine; N,N'-dinaphthyltoluamidine; N,N'-dicyclohexyltoluamidine; N,N'-dinorbornyltoluamidine; N,N'-diadamantyltoluamidine; oxalic diamidine; malonic diamidine; succinic diamidine; glutaric diamidine; adipic diamidine; pimelic diamidine; suberic diamidine; phthalic diamidine; terephthalic diamidine; isophthalic diamidine; piperazine diamidine; 2-iminopyrrolidine; and 2-iminopiperidine.

Examples of guanidines, diguanidines, and polyguanidines include, but are not limited to: guanidine; methylguanidine; ethylguanidine; isopropylguanidine; butylguanidine; benzylguanidine; phenylguanidine; tolylguanidine; naphthylguanidine; cyclohexylguanidine; norbornylguanidine; adamantylguanidine; dimethylguanidine; diethylguanidine; diisopropylguanidine; dibutylguanidine; dibenzylguanidine; diphenylguanidine; ditolylguanidine; dinaphthylguanidine; dicyclohexylguanidine; dinorbornylguanidine; diadamantylguanidine; ethylenediguanidine; propylenediguanidine; tetramethylenediguanidine; pentamethylenediguanidine; hexamethylenediguanidine; heptamethylenediguanidine; octamethylenediguanidine; phenylenediguanidine; piperazinediguanidine; oxalyldiguanidine; malonyldiguanidine; succinyldiguanidine; glutaryldiguanidine; adipyldiguanidine; pimelyldiguanidine; suberyldiguanidine; phthalyldiguanidine; benzimidazoleguanidine; aminoguanidine; nitroaminoguanidine; and dicyandiamide (cyanoguanidine).

Examples of biguanides (imidodicarbonimidic diamides), biguanidines, imidotricarbonimidic diamides, imidotetracarbonimidic diamides, dibiguanides, bis(biguanidines), polybiguanides, and poly(biguanidines) include, but are not limited to: biguanide (bigH); biguanidine, methylbiguanide; ethylbiguanide; isopropylbiguanide; butylbiguanide; benzylbiguanide; phenylbiguanide; tolylbiguanide; naphthylbiguanide; cyclohexylbiguanide; norbornylbiguanide; adamantylbiguanide; dimethylbiguanide; diethylbiguanide; diisopropylbiguanide; dibutylbiguanide; dibenzylbiguanide; diphenylbiguanide; ditolylbiguanide; dinaphthylbiguanide; dicyclohexylbiguanide; dinorbornylbiguanide; diadamantylbiguanide; ethylenedibiguanide; propylenedibiguanide; tetramethylenedibiguanide; pentamethylenedibiguanide; hexamethylenedibiguanide; heptamethylenedibiguanide; octamethylenedibiguanide; phenylenedibiguanide; piperazinedibiguanide; oxalyldibiguanide; malonyldibiguanide; succinyldibiguanide; glutaryldibiguanide; adipyldibiguanide; pimelyldibiguanide; suberyldibiguanide; phthalyldibiguanide; paludrine; and polyhexamethylene biguanide.

Examples of imidosulfamides, diimidosulfamides, bis(imidosulfamides), bis(diimidosulfamides), poly(imidosulfamides), and poly(diimidosulfamides) include, but are not limited to: imidosulfamidic acid, diimidosulfamidic acid; O-phenylimidosulfamide; O-benzylimidosulfamide; N-phenylimidosulfamide; N-benzylimidosulfamide; O-phenyldiimidosulfamide; O-benzyldiimidosulfamide; N-phenyldiimidosulfamide; and N-benzyldiimidosulfamide.

Examples of phosphoramidimidic triamides, bis(phosphoramidimidic triamides), and poly(phosphoramidimidic triamides) and derivatives thereof include, but are not limited to: phosphoramidimidic triamide; N-phenylphosphoramidimidic triamide; N-benzylphosphoramidimidic triamide; N-naphthylphosphoramidimidic triamide; N-cyclohexylphosphoramidimidic triamide; N-norbornylphosphoramidimidic triamide; N,N'-diphenylphosphoramidimidic triamide; N,N'-dibenzylphosphoramidimidic triamide; N,N'-dinaphthylphosphoramidimidic triamide; N,N'-dicyclohexylphosphoramidimidic triamide; and N,N'-dinorbornylphosphoramidimidic triamide.

Examples of phosphoramidimidic acid, phosphorodiamidimidic acid, bis(phosphoramidimidic acid), bis(phosphorodiamidimidic acid), poly(phosphoramidimidic acid), poly(phosphorodiamidimidic acid), and derivatives thereof include, but are not limited to: phosphoramidimidic acid, phosphorodiamidimidic acid, O-phenylphosphoramidimidic acid; O-benzylphosphoramidimidic acid; O-naphthylphosphoramidimidic acid; O-cyclohexylphosphoramidimidic acid; O-norbornylphosphoramidimidic acid; O,O'-diphenylphosphoramidimidic acid; O,O'-dibenzylphosphoramidimidic acid; O,O'-dinaphthylphosphoramidimidic acid; O,O'-dicyclohexylphosphoramidimidic acid; and O,O'-dinorbornylphosphoramidimidic acid.

Examples of phosphonimidic diamides, bis(phosphonimidic diamides), and poly(phosphonimidic diamides) include, but are not limited to: phosphonimidic diamide; N-benzylphosphonimidic diamide; N-phenylphosphonimidic diamide; N-cyclohexylphosphonimidic diamide; N-norbornylphosphonimidic diamide; N,N-dibenzylphosphonimidic diamide; N,N-diphenylphosphonimidic diamide; N,N-dicyclohexylphosphonimidic diamide; and N,N-dinorbornylphosphonimidic diamide.

Examples of phosphonamidimidic acid, bis(phosphonamidimidic acid), poly(phosphonamidimidic acid), and derivatives thereof include, but are not limited to: phosphonamidimidic acid, phosphonamidimidothioic acid; O-phenylphosphonamidimidic acid; O-benzylphosphonamidimidic acid; O-cyclohexylphosphonamidimidic acid; O-norbornylphosphonamidimidic acid; S-phenylphosphonamidimidothioic acid; S-benzylphosphonamidimidothioic acid; S-cyclohexylphosphonamidimidothioic acid; and S-norbornylphosphonamidimidothioic acid.

Examples of azo compounds with amino, imino, oximo, diazeno, or hydrazido substitution at the ortho-(for aryl) or alpha- or beta-(for alkyl) positions, bis[o-($H_2N$—) or alpha- or beta-($H_2N$—)azo compounds], or poly[o-($H_2N$—) or alpha- or beta-($H_2N$—)azo compounds) include, but are not limited to: o-aminoazobenzene; o,o'-diaminoazobenzene; (2-pyridine)azobenzene; 1-phenylazo-2-naphthylamine; pyridineazo-2-naphthol (PAN); pyridineazoresorcinol (PAR); o-hydroxy-o'-(beta-aminoethylamino)azobenzene; Benzopurpurin 4B; Congo Red; and Fat Brown RR.

Examples of ortho-amino (or -hydrazido) substituted formazans, bis(o-amino or -hydrazido substituted formazans), and poly(o-amino or -hydrazido substituted formazans) include, but are not limited to: 1-(2-aminophenyl)-3,5-diphenylformazan; and 1,5-bis(2-aminophenyl)-3-phenylformazan.

Examples of ortho-amino (or -hydrazido) substituted azines (including ketazines), bis(o-amino or hydrazido substituted azines), and poly(o-amino or hydrazido substituted azines) include, but are not limited to: 2-amino-1-benzalazine; 2-amino-1-naphthalazine; and 2-amino-1-cyclohexanonazine.

Examples of Schiff Bases with one Imine (C═N) Group and with ortho- or alpha- or beta-amino or imino or oximo or diazeno or hydrazido substitution include, but are not limited to: N-(2-Aminobenzaldehydo)isopropylamine; N-(2-Pyridinecarboxaldehydo)isopropylamine; N-(2-Pyrrolecarboxaldehydo)isopropylamine; N-(2-Acetylpyridino)isopropylamine; N-(2-Acetylpyrrolo)isopropylamine; N-(2-Aminoacetophenono)isopropylamine; N-(2-Aminobenzaldehydo)cyclohexylamine; N-(2-Pyridinecarboxaldehydo)cyclohexylamine; N-(2-Pyrrolecarboxaldehydo)cyclohexylamine; N-(2-Acetylpyridino)cyclohexylamine; N-(2-Acetylpyrrolo)cyclohexylamine; N-(2-Aminoacetophenono)cyclohexylamine; N-(2-Aminobenzaldehydo)aniline; N-(2-Pyridinecarboxaldehydo)aniline; N-(2-Pyrrolecarboxaldehydo)aniline; N-(2-Acetylpyridino)aniline; N-(2-Acetylpyrrolo)aniline; N-(2-Aminoacetophenono)aniline; N-(2-Aminobenzaldehydo)aminonorbornane; N-(2-Pyridinecarboxaldehydo)aminonorbornane; N-(2-Pyrrolecarboxaldehydo)aminonorbornane; N-(2-Acetylpyridino)aminonorbornane; N-(2-Acetylpyrrolo)aminonorbornane; and N-(2-Aminoacetophenono)aminonorbornane.

Examples of Schiff Bases with two Imine (C═N) Groups and without ortho-(for aryl constituents) or alpha- or beta-(for alkyl constituents) hydroxy, carboxy, carbonyl, thiol, mercapto, thiocarbonyl, amino, imino, oximo, diazeno, or hydrazido substitution include, but are not limited to: N,N'-(Glyoxalo)diisopropylamine; N,N'-(Glyoxalo)dicyclohexylamine; N,N'-(Glyoxalo)dianiline; N,N'-(Glyoxalo)di-aminonorbornane; N,N'-(Malondialdehydo)diisopropylamine; N,N'-(Malondialdehydo)dicyclohexylamine; N,N'-(Malondialdehydo)dianiline; N,N'-(Malondialdehydo)di-aminonorbornane; N,N'-(Phthalicdialdehydo)diisopropylamine; N,N'-(Phthalicdialdehydo)dicyclohexylamine; N,N'-(Phthalicdialdehydo)dianiline; N,N'-(Phthalicdialdehydo)di-aminonorbornane; N,N'-(Formylcamphoro)diisopropylamine; N,N'-(Formylcamphoro)dicyclohexylamine; N,N'-(Formylcamphoro)dianiline; N,N'-(Formylcamphoro)di-aminonorbornane; N,N'-(Acetylacetonato)diisopropylamine; N,N'-(Acetylacetonato)dicyclohexylamine; N,N'-(Acetylacetonato)dianiline; N,N'-(Acetylacetonato)di-aminonorbornane; N,N'-(Diacetylbenzeno)diisopropylamine; N,N'-(Diacetylbenzeno)dicyclohexylamine; N,N'-(Diacetylbenzeno)dianiline; N,N'-(Diacetylbenzeno)di-aminonorbornane; N,N'-(1,2-Cyclohexanono)diisopropylamine; N,N'-(1,2-Cyclohexanono)dicyclohexylamine; N,N'-(1,2-Cyclohexanono)dianiline; N,N'-(1,2-Cyclohexanono)di-aminonorbornane; N,N'-(Camphorquinono)diisopropylamine; N,N'-(Camphorquinono)dicyclohexylamine; N,N'-(Camphorquinono)dianiline; N,N'-(Camphorquinono)di-aminonorbornane; N,N'-(Benzaldehydo)ethylenediamine; N,N'-(Naphthaldehydo)ethylenediamine; N,N'-(Acetophenono)ethylenediamine; N,N'-(Benzaldehydo)trimethylenediamine; N,N'-(Naphthaldehydo)trimethylenediamine; N,N'-(Acetophenono)trimethylenediamine; N,N'-(Benzaldehydo)cyclohexane-1,2-diamine; N,N'-(Naphthaldehydo)cyclohexane-1,2-diamine; N,N'-(Acetophenono)cyclohexane-1,2-diamine; N,N'-(Benzaldehydo)-1,2-diaminobenzene; N,N'-(Naphthaldehydo)-1,2-diaminobenzene; N,N'-(Acetophenono)-1,2-diaminobenzene; N,N'-(Acetylacetonato)ethylenediamine; N,N'-(Acetylacetonato)-1,2-cyclohexylenediamine; N,N'-(Acetylacetonato)-1,2-propylenediamine; N,N'-(Glyoxalo)-o-phenylenediamine; and N,N'-(Glyoxalo)ethylenediamine.

Examples of Schiff Bases with two Imine (C═N) Groups and with ortho- or alpha- or beta-amino or imino or oximo or diazeno or hydrazido substitution include, but are not limited to: N,N'-(2,6-Pyridinedicarboxaldehydo)diisopropylamine; N,N'-(2,6-Pyridinedicarboxaldehydo)dicyclohexylamine; N,N'-(2,6-Pyridinedicarboxaldehydo)dianiline; N,N'-(2,6-Pyridinedicarboxaldehydo)di-aminonorbornane; N,N'-(2,5-Pyrroledicarboxaldehydo)diisopropylamine; N,N'-(2,5-Pyrroledicarboxaldehydo)dicyclohexylamine; N,N'-(2,5-Pyrroledicarboxaldehydo)dianiline; N,N'-(2,5-Pyrroledicarboxaldehydo)di-aminonorbornane; N,N'-(o-Aminophthalicdialdehydo)diisopropylamine; N,N'-(o-Aminophthalicdialdehydo)dicyclohexylamine; N,N'-(o-Aminophthalicdialdehydo)dianiline; N,N'-(o-Aminophthalicdialdehydo)di-aminonorbornane; N,N'-(o-Aminoformylcamphoro)diisopropylamine; N,N'-(o-Aminoformylcamphoro)dicyclohexylamine; N,N'-(o-Aminoformylcamphoro)dianiline; N,N'-(o-Aminoformylcamphoro)di-aminonorbornane; N,N'-(2,6-Diacetylpyridino)diisopropylamine; N,N'-(2,6-Diacetylpyridino)dicyclohexylamine; N,N'-(2,6-Diacetylpyridino)dianiline; N,N'-(2,6-Diacetylpyridino)di-aminonorbornane; N,N'-(o-Aminodiacetylbenzeno)diisopropylamine; N,N'-(o-Aminodiacetylbenzeno)dicyclohexylamine; N,N'-(o-Aminodiacetylbenzeno)dianiline; N,N'-(o-Aminodiacetylbenzeno)di-aminonorbornane; N,N'-(3,6-Diamino-1,2-cyclohexanono)diisopropylamine; N,N'-(3,6-Diamino-1,2-cyclohexanono)dicyclohexylamine; N,N'-(3,6-Diamino-1,2-cyclohexanono)dianiline; N,N'-(3,6-Diamino-1,2-cyclohexanono)di-aminonorbornane; N,N'-(2,5-Diacetylpyrrolo)diisopropylamine; N,N'-(2,5-Diacetylpyrrolo)dicyclohexylamine; N,N'-(2,5-Diacetylpyrrolo)dianiline; N,N'-(2,5-Diacetylpyrrolo)di-aminonorbornane; N,N'-(o-Aminobenzaldehydo)ethylenediamine; N,N'-(o-Aminonaphthaldehydo)ethylenediamine; N,N'-(o-Aminoacetophenono)ethylenediamine; N,N'-(o-Aminobenzaldehydo)trimethylenediamine; N,N'-(o-Aminonaphthaldehydo)trimethylenediamine; N,N'-(o-Aminoacetophenono)trimethylenediamine; N,N'-(o-Aminobenzaldehydo)cyclohexane-1,2-diamine; N,N'-(o-Aminonaphthaldehydo)cyclohexane-1,2-diamine; N,N'-(o-Aminoacetophenono)cyclohexane-1,2-diamine; N,N'-(o-Aminobenzaldehydo)-1,2-diaminobenzene; N,N'-(o-Aminonaphthaldehydo)-1,2-diaminobenzene; and N,N'-(o-Aminoacetophenono)-1,2-diaminobenzene.

Examples of Schiff Bases with three Imine (C═N) Groups and without ortho- (for aryl constituents) or alpha- or beta-(for alkyl constituents) hydroxy, carboxy, carbonyl, thiol, mercapto, thiocarbonyl, amino, imino, oximo, diazeno, or hydrazido substitution include, but are not limited to: N,N',N"-(Benzaldehydo)tris(2-aminoethyl)amine; N,N',N"-(Naphthaldehydo)tris(2-aminoethyl)amine; and N,N',N"-(Acetophenono)tris(2-aminoethyl)amine.

Examples of Schiff Bases with three Imine (C═N) Groups and with ortho- or alpha- or beta-amino or imino or oximo or diazeno or hydrazido substitution include, but are not limited to: N,N',N"-(o-Aminobenzaldehydo)tris(2-aminoethyl)amine; N,N',N"-(o-Aminonaphthaldehydo)tris(2-aminoethyl)amine; and N,N',N"-(o-Aminoacetophenono)tris(2-aminoethyl)amine.

Examples of triazenes include, but are not limited to: N,N'-diphenyltriazene, N,N'-ditolyltriazene, N,N'-dixylyltriazene, N,N'-dicyclohexyltriazene, and alpha-hydroxytriazenes.

Examples of hydrazones, bis(hydrazones), and poly(hydrazones) include, but are not limited to: acetaldehyde hydrazone; acetaldehyde phenylhydrazone; acetone hydrazone; acetone phenylhydrazone; pinacolone hydrazone; pinacolone phenylhydrazone; benzaldehyde hydrazone; benzaldehyde phenylhydrazone; naphthaldehyde hydrazone; naphthaldehyde phenylhydrazone; norbornanone hydrazone; norbornanone phenylhydrazone; camphor hydrazone; camphor phenylhydrazone; nopinone hydrazone; nopinone phenylhydrazine; 2-pyridinaldehyde hydrazone; 2-pyridinealdehyde phenylhydrazone; salicylaldehyde hydrazone; salicylaldehyde phenylhydrazone; quinolinaldehyde hydrazone; quinolinaldehyde phenylhydrazone; isatin dihydrazone; isatin di(phenylhydrazone); camphorquinone dihydrazone; camphorquinone di(phenylhydrazone); and 2-hydrazinobenzimidazole hydrazone.

Examples of hydramides include, but are not limited to: hydrobenzamide; hydronaphthamide; and hydrosalicylamide.

Phosphorus-containing complexing agents can also function as complexing agents for the electroless zinc deposition process. Unsubstituted phosphonium ions ($PH_4^+$) are unstable in aqueous solution, but substituted phosphonium ions ($PR_4^+$) can be used instead of substituted ammonium ions in aqueous solution. R preferentially represents an alkyl, aromatic, or acyclic organic constituent of size $C_1$ (methyl) through $C_8$ (octyl or tolyl). The organic constituents on the substituted phosphonium ion do not necessarily have to be of the same molecular size or geometry. Thus, for example, methyltriethylphosphonium [$PMeEt_3^+$] is an acceptable complexing agent for this process. Organic constituents larger than $C_8$ are less desirable because the cost of the substituted phosphonium reagents is much higher, and the solubility of these larger substituted phosphonium ions in water (the preferred solvent) decreases rapidly. Fluorides and lactates of these substituted phosphonium compounds offer the highest solubility in water, although chlorides, bromides, iodides, acetates, formates, and propionates also offer acceptable solubilities in water.

Phosphines and aromatic phosphines can be used as complexing agents. These are generally useful only for nonaqueous deposition solutions. A possible advantage to the use of phosphines over amines is that phosphines generally stretch the zinc electron shells even further than amines, further lowering the energy requirements for reduction of zinc to the elemental state. This further facilitates the deposition of zinc. Examples of each analogous subcategory are listed below.

Examples of monophosphines include, but are not limited to: phosphine, phenylphosphine, diphenylphosphine, triphenylphosphine, tricyclohexylphosphine, phenyldimethylphosphine, phenyldiethylphosphine, methyldiphenylphosphine, ethyldiphenylphosphine, phosphirane, phosphetane, phospholane, phosphorinane, benzophospholane, benzophosphorinane, dibenzophospholane, dibenzophosphorinane, naphthophospholane, naphthophosphorinane, phosphinonorbornane, and phosphinoadamantane.

Examples of diphosphines include, but are not limited to: diphospholane, benzodiphospholane, naphthodiphospholane, diphosphorinane, benzodiphosphorinane, dibenzodiphosphorinane, naphthodiphosphorinane, bis(diphenylphosphino)methane, bis(diphenylphosphino)ethane, bis(diphenylphosphino)propane, bis(diphenylphosphino)butane, bis(diphenylphosphino)pentane, 1,2-bis(diphenylphosphino)ethylene, and o-phenylenebis(diphenylphosphine). (Note: the aryl derivatives are air-stable, whereas the alkyl derivatives are air-sensitive and therefore unsuitable for these applications.)

xamples of triphosphines include, but are not limited to: triphosphorinane, P,P'-tetraphenyl-2-methyl-2-(P-diphenyl)phosphinomethyl-1,3-propanediphosphine; P,P-[2-(P-diphenyl)phosphinoethyl]diethyl-P-phenylphosphine; P,P-[2-(P-diphenyl)phosphino]diphenyl-P-phenylphosphine; and hexahydro-2,4,6-trimethyl-1,3,5-triphosphazine. (Note: the aryl derivatives are air-stable, whereas the alkyl derivatives are air-sensitive and therefore unsuitable for these applications.)

Examples of tetraphosphines include, but are not limited to: P,P'-tetraphenyl-2,2-[(P-diphenyl)phosphinomethyl]-1,3-propanediphosphine; tri[o-(P-diphenyl)phosphinophenyl]phosphine; and 1,1,4,7,10,10-hexaphenyl-1,4,7,10-tetraphosphadecane. (Note: the aryl derivatives are air-stable, whereas the alkyl derivatives are air-sensitive and therefore unsuitable for these applications.)

Examples of pentaphosphines include, but are not limited to: 4-[2-(P-diphenyl)phosphinoethyl]-1,1,7,10,10-pentaphenyl-1,4,7,10-tetraphosphadecane. (Note: the aryl derivatives are air-stable, whereas the alkyl derivatives are air-sensitive and therefore unsuitable for these applications.)

Examples of hexaphosphines include, but are not limited to: 1,1,10,10-tetraphenyl-4,7-[2-(P,P-diphenyl)phosphinoethyl]-1,4,7,10-tetraphosphadecane. (Note: the aryl derivatives are air-stable, whereas the alkyl derivatives are air-sensitive and therefore unsuitable for these applications.)

Examples of 5-membered heterocyclic rings that contain one phosphorus atom include, but are not limited to: 1-phospholene, 2-phospholene, 3-phospholene, phosphole, oxaphosphole, thiaphosphole, benzophospholene, benzophosphole, benzoxaphosphole, benzothiaphosphole, dibenzophospholene, dibenzophosphole, naphthophospholene, naphthophosphole, naphthoxaphosphole, naphthothiaphosphole.

Examples of 5-membered heterocyclic rings that contain two phosphorus atoms include, but are not limited to: diphospholene, diphosphole, oxadiphospholene, thiadiphospholene, benzodiphospholene, benzodiphosphole, naphthodiphospholene, and naphthodiphosphole.

Examples of 5-membered heterocyclic rings that contain three phosphorus atoms include, but are not limited to: triphosphole.

Examples of 6-membered heterocyclic rings that contain one phosphorus atom include, but are not limited to: phosphorin, oxaphosphorin, thiaphosphorin, benzophosphorin, benzoxaphosphorin, benzothiaphosphorin, acridophosphine, phosphanthridine, dibenzoxaphosphorin, dibenzothiaphosphorin, naphthophosphorin, naphthoxaphosphorin, and naphthothiaphosphorin.

Examples of 6-membered heterocyclic rings that contain two phosphorus atoms include, but are not limited to: o-diphosphorin, m-diphosphorin, p-diphosphorin, oxadiphosphorin, thiadiphosphorin, benzodiphosphorin, benzoxadiphosphorin, benzothiadiphosphorin, dibenzodiphosphorin, dibenzoxadiphosphorin, dibenzothiadiphosphorin, naphthodiphosphorin, naphthoxadiphosphorin, and naphthothiadiphosphorin.

Examples of 6-membered heterocyclic rings that contain three phosphorus atoms include, but are not limited to: 1,3,5-triphosphorin, 1,2,3-triphosphorin, benzo-1,2,3-triphosphorin, and naphtho-1,2,3-triphosphorin.

Solubility compatibility with the other constituents in the first bath should be considered. For example, use of large concentrations of ammonium citrate as an ammonium (complexing agent) source may deplete an aqueous solvent system of zinc due to the lower solubility (~0.5 M) of zinc citrate in water. Adding ammonium citrate to a water-based solvent system that contains the desired 2.5 to 5.0 M of zinc will precipitate most of the zinc as zinc citrate, leaving only 0.5 M of zinc in this solution. Through careful selection of zinc, preparative agent, and complexing agent sources for a given solvent system (i.e., water) it is possible to retain all constituents in solution.

For complexing agents that have more than one binding site, lower ratios of complexing agent to zinc can be used. Table 5 shows the typical ratio of complexing agent to zinc as a function of the number of binding sites on the complexing agent.

TABLE 5

Preferred Ratios of Complexing Agent to Zinc As a Function of Bonding Sites

| # of Bonding Sites | Highest Allowable Ratio | Lowest Allowable Ratio | Preferred Highest Ratio | Preferred Lowest Ratio |
|---|---|---|---|---|
| One (e.g., monoamines) | 4:1 | 0.5:1 | 4:1 | 2:1 |
| Two (e.g., diamines) | 2:1 | 0.25:1 | 2:1 | 1:1 |
| Three (e.g., Triamines) | 2:1 | 0.25:1 | 2:1 | 1:1 |
| Four (e.g., Tetramines) | 1:1 | 0.1:1 | 1:1 | 0.5:1 |
| Five (e.g., Pentamines) | 1:1 | 0.1:1 | 1:1 | 0.5:1 |
| Six (e.g., Hexamines) | 1:1 | 0.1:1 | 1:1 | 0.5:1 |

The concentration of complexing agent can be related in terms of the ratio of complexing agent to zinc. For those complexing agents that contain just one bonding site (e.g., ammonium, substituted ammonium, monoamines), the lowest desirable ratio of nitrogen- (or phosphorus-) containing complexing agent to zinc is about 0.5:1, while the highest ratio desirable is found to be about 4:1. Optimally, however, ratios greater than or equal to about 2:1, but less than or equal to about 4:1 are desirable. Ratios of complexing agent-to-zinc less than about 2:1 are less desirable due to insufficient complexing of the zinc in the first electroless plating solution. For some higher preferred zinc concentrations (e.g., 5.0 M), it is not possible to achieve high ratios (e.g., 3:1 or 4:1) of complexing agent-to-zinc, due to the maximum solubility limits of the precursor complexing agent compounds. For example, a 5.0 M solution of zinc would require 15.0 M of ammonium for a 3:1 ratio, and 20.0 M of ammonium for a 4:1 ratio.

Another component desirable in the composition is the reducing agent, also known as the "fixer." Any reducing agent with a reduction potential lower than about −0.76 volts in acidic conditions, or lower than about −1.04 volts under basic conditions can be used as a reducing agent for this process. Reducing agents that exhibit these characteristics include the formate ion ($HCO_2^-$, −1.11 V basic), the borohydride ion ($BH_4^-$, −1.24 V basic) as well as other tetraborates such as tetraphenylborate, the hypophosphite ion ($PO_2^{-3}$, −1.57 V basic), hydroxylamine ($NH_2OH$, −1.05 V basic) and hydroxamates, and the dithionite ion ($S_2O_4^{-2}$, ~−1.15 V basic). Other, more "exotic" examples may be possible such as trivalent titanium, trivalent vanadium, and divalent chromium. The hypophosphite ion is desirable due to its low redox potential and stability in aqueous solution. The zinc coatings obtained with the other reducing agents were found to be of lower quality than those obtained with hypophosphite.

Hypophosphites are also termed phosphinates. Any source of the hypophosphite ion can be used for this application. Table 5 shows the solubility in water of some conventional hypophosphite compounds.

TABLE 6

Maximum Solubility of Some Hypophosphite Precursors (moles/liter $PO_2^{-3}$ at 20 to 30° C.)

| Hypophosphite Precursor | Solubility |
|---|---|
| Hypophosphorous acid | ~10 |
| Ammonium hypophosphite | ~8 |
| Lithium hypophosphite | ~5 |
| Sodium hypophosphite | 9.4 |
| Potassium hypophosphite | 19.2 |

The concentration of the hypophosphite may affect the quality of the formed electroless zinc coating. Concentrations of hypophosphite greater than or equal to about 0.5 M, but less than or equal to about 1.0 M were found to be desirable. With concentrations lower than about 0.5 M, very thin deposits of zinc that are nonuniform in coverage are formed. This may result in inadequate corrosion protection. With concentrations greater than about 1.0 M, increasing amounts of white zinc phosphate are deposited in the formed electroless zinc coating. This may adversely affect any subsequent conversion coating or phosphating application on the deposited zinc.

Optionally, an electroless alloy of zinc with other elements can be achieved. This offers many advantageous attributes to the formed electroless zinc coating. For example, alloying with other elements can reduce the amount of "white rust" (zinc oxide) that is formed when the sacrificial zinc coating is corroded. Alloying with other elements can also improve the mechanical attributes of the electroless zinc coating. Finally, the use of additional alloying constituents can improve the adherence of subsequently-applied paint layers to the electroless zinc coating by modifying the crystal structure of surface layers obtained by phosphating or conversion coating the zinc coating.

Elements that can be alloyed with zinc using this process include, but are not limited to: 1) tin (Sn); 2) indium (In); 3) nickel (Ni); 4) copper (Cu); 5) cobalt (Co); 6) cadmium (Cd); 7) silver (Ag); 8) lead (Pb); 9) antimony (Sb); 10) bismuth (Bi); and even 11) iron (Fe). Copper and silver are less desirable alloying elements because the high redox potential exhibited by their precursor ions in solution implies that copper or silver will be preferentially deposited, thereby using up desirable reducing agent, and lowering the amount of zinc deposited. The corrosion-resistance of zinc electrolessly alloyed with copper can also be lower. Alloying elements that are more desirable include tin, indium, nickel, cobalt, and iron. The corrosion resistance of electroless zinc alloyed with these elements (especially indium) was found to be slightly higher than using pure zinc alone.

Water-soluble precursors for these elements are desirable, so that an aqueous system can be applied to the work piece. Chlorides, bromides, and sulfates typically offer the highest aqueous solubilities. These agents typically are added to the first solution containing the zinc.

'Thickening agents' may be added to the composition that acts to increase the viscosity of the solutions, thereby ensuring that the solutions remain in the vicinity in which they were applied. Examples of organic "thickening agents" include, but are not limited to: starch (e.g. corn or arrowroot), dextrin, gum arabic, albumin, gelatin, glue, saponin, gum mastic, gum xanthan, hydroxyalkyl celluloses (e.g. hydroxyethyl cellulose), polyvinyl alcohols, polyacrylic acid and its esters, polyacrylamides, ethylene oxide polymers (e.g. Polyox™ water-soluble resins), polyvinylpyrrolidone, alkyl vinyl ether copolymers (e.g. Ganfrey AN™), colloidal suspensions of aluminum oxide or hydrated aluminum oxide, colloidal suspensions of magnesium oxide or hydroxide, and colloidal suspensions of silicon or titanium oxides. Examples of inorganic "thickening agents" include, but are not limited to: colloidal suspensions of aluminum oxide or hydrated aluminum oxide (e.g. boehmite or Baymal™), colloidal suspensions of magnesium oxide or hydroxide, or colloidal suspensions of silicon or titanium oxides. The use of "thickening agents" helps to eliminate 'run off' to areas in which zinc deposition is not desired or needed. The thickening agents are generally employed in amounts between about 0.1 and about 50 by weight of thickening agent per 100 parts by weight of water. Typically, the thickening agent is employed in amounts between about 0.1 and about 20 parts by weight of thickening agent per 100 parts by weight of water.

The process for the application of the electroless zinc solutions may include precleaning, masking, rinsing, applying the first electroless zinc solution, applying the second electroless zinc solution, rinsing, and then drying.

The precleaning step is performed only when desired in order to remove contaminants or debris, such as heavy oils or greases, from the surface to be coated. The precleaning is performed by using material such as detergents, alkaline cleaners, or solvents. The technique used to preclean the surface may vary depending on the contaminant or debris that is to be removed. Any appropriate technique, such as wipe cleaning, can be used.

The next step in the process is masking. If necessary, masking is only performed, if necessary, on any areas that are not to be coated with the electroless zinc coating. Any system component that may be adversely affected by the electroless zinc coating process should also be masked off in order to protect these areas.

The surface is then rinsed, if necessary, with standard rinse procedures. Typically deionized water is used to rinse the surfaces.

The properties of the formed zinc or zinc-alloy coating can be further enhanced by treating the work piece with a reducing solution prior to the application of the zinc-containing solution. This reducing solution corresponds to those having reduction potentials lower than about −0.76 volts in acidic conditions, or lower than about −1.04 volts under basic conditions. Representative examples include formates, borohydrides, tetraborates, hypophosphites, hydroxylamines or hydroxamates, dithionites, and trivalent titanium. An adsorbed layer of this reducing agent initiates the reduction of zinc at the work piece surface to provide nuclei on which the rest of the layer can grow. The pretreated workpiece is then rinsed with deionized water prior to exposure to the zinc-containing solution. If pretreatment with a reducing agent is used, the preparative agent may not be necessary; the pretreatment with the reducing agent may serve as the preparative agent.

The zinc solution is then applied to the surface. The solution may be applied by standard immersion, spray application, fogging, or manual application processes. The zinc solution typically comprises a zinc source and a complexing agent. A preparative agent may be used if needed.

Next, the second solution containing reducing agent ("fixer") is applied. This solution may also be applied by immersion, spray application, fogging, or manual application. If the first solution is impinged onto the treated surface, the second solution can be applied simultaneously. Otherwise, the second solution may be applied at some time interval after the first treatment solution.

The time between application of the first and second solution was found to be a factor to the performance of the coating. Insufficient time between application of the first solution and the second "fixer" solution may result in lower adherence to the substrate metal because the preparative agent is not allowed enough time to back-etch the work piece. If the zinc-containing solution is forced onto/into the substrate, then the second 'fixer' solution can be applied simultaneously. Long time durations between the two solutions can result in evaporation of the first solution, run-off, or other processing difficulties. If no impinging of the first solution into the substrate is involved (as through the use of a high pressure sprayer), the time between the two solutions is preferably not less than five (5) minutes, and preferably not greater than one (1) hour. The contact time between the two solutions generally should be between 15 and 30 minutes.

After the application of the two solutions, the surface is typically rinsed with deionized water. Standard rinse procedures are used.

If necessary, the surface is dried using standard drying methods. Typical drying methods include, but are not limited to, blow drying to evaporate the water.

An electroless plating system is also provided comprising a first bath containing a zinc source and a complexing agent for the zinc. A preparative agent may also be used. Preferably, the preparative agent is a fluoride source. The system may further include a second bath containing a strong reducing agent. The reducing agent has a reduction potential lower than −0.76 volts in acidic conditions. The reducing agent has a reduction potential lower than −1.04 volts under basic conditions. The first bath may further include a source of additional metals with the zinc to form zinc-containing alloys. The first bath may also include organic thickening agents. The zinc source, complexing agent for the zinc, the preparative agent, and the reducing agent are all described above.

The electroless plating composition and process of the present invention is described in more detail by way of the following examples, which are intended to be illustrative of the invention, but not intended to be limiting in scope.

EXAMPLE 1

A sample, 1008 cold-rolled carbon steel sheet, was exposed to a solution comprising 4.0 M zinc chloride, 8.0 M ammonium chloride, and 0.07 M potassium hexafluorozirconate (0.42 M of available F−). The sample was exposed to the solution for 15 minutes of exposure. The sample was exposed to a second solution containing 1.0 M sodium hypophosphite and enough potassium hydroxide to provide a pH of 12 for the second solution. A fine surface coating of elemental zinc was formed on the surface of the sample.

The sample was exposed to ASTM B-117 accelerated Salt Fog exposure. This surface film of zinc delayed the appearance of red rust from 4 hours for an untreated piece to between 8 and 12 hours on the surface of the work piece with the surface coating. The appearance of rust depends upon the porosity of the formed zinc coating.

The coating formed is readily chromated, as with a chromium trioxide rinse, to provide further corrosion protection. It was observed that some commercial chromating solutions, such as Alodine 1200, removed the produced zinc coating from the work piece due to the action of its constituent fluorides. Parts protected with just a chromate rinse over the electroless zinc did not exhibit red rust for an average of 16 hours in ASTM B-117.

EXAMPLE 2

A sample, 1008 cold-rolled carbon steel sheet, was exposed to a solution comprising 4.0 M zinc chloride, 8.0 M ammonium chloride, and 0.07 M potassium hexafluorozirconate (0.42 M of available F—) for 15 minutes. The sample was then exposed to a second solution containing 2.0 M sodium hypophosphite and enough potassium hydroxide to provide a pH of 12 for the second solution.

A fine surface coating comprising both elemental zinc and zinc phosphate (formed via oxidation of the hypophosphite fixer to phosphate ions, with precipitation in the presence of zinc ions) was observed on the surface of the part. This coating increased the corrosion protection of the steel substrate, extending the appearance time for red rust from 4 hours for an untreated piece to 8 to 12 hours in ASTM B-117 Salt Fog accelerated exposure.

This coating is not as readily chromated as the pure zinc film produced described in Example 1. No measurable increase in corrosion protection was afforded via chromating these films.

EXAMPLE 3

A sample, 1008 cold-rolled carbon steel sheet, was sprayed simultaneously with two solutions. The first solution comprised 4.0 M zinc chloride, 8.0 M ammonium chloride, 0.07 M potassium hexafluorozirconate (0.42 M of available F—). The second solution comprised 1.0 M sodium hypophosphite and enough potassium hydroxide to provide a pH of 12 for the second solution.

A fine surface coating of elemental zinc was formed on the surface. When exposed to ASTM B-117 accelerated Salt Fog exposure, this surface coating of zinc extended the appearance of red rust on the surface of the workpiece from 4 hours for an untreated piece to between 8 and 12 hours on the surface of the work piece. The porosity of this coating was substantially less than that described in Example 1 above.

EXAMPLE 4

A sample, 1008 cold-rolled carbon steel sheet, was first exposed to a solution of 'fixer' comprising 1.0 M sodium hypophosphite and enough potassium hydroxide to provide a pH of 12 for the solution.

The work piece was then rinsed with deionized water, and sprayed simultaneously with two solutions. The first solution comprised 4.0 M zinc chloride and 8.0 M ammonium chloride. The second solution comprised 1.0 M sodium hypophosphite and enough potassium hydroxide to adjust the pH to 12.

The elemental zinc layer formed by this process was somewhat thicker than that described in Example 3 above, and was less porous than that described in Example 1. When exposed to ASTM B-117 accelerated Salt Fog exposure, this surface coating of zinc extended the appearance of red rust on the surface of the workpiece from 4 hours for an untreated piece to between 12 and 16 hours on the surface of the work piece. This coating was readily amenable to chromate rinsing for further corrosion protection.

EXAMPLE 5

A sample, 1008 cold-rolled carbon steel sheet, was first exposed to a solution comprising 3.6 M zinc chloride, 0.4 M indium chloride, 8.0 M ammonium chloride, and 0.07 M potassium hexafluorozirconate (0.42 M of available F—) for 15 minutes. The sample was exposed to a second solution containing 1.0 M sodium hypophosphite and enough potassium hydroxide to provide a pH of 12 for the second solution.

A fine surface coating of 90% zinc and 10% indium was formed on the surface. When exposed to ASTM B-117 accelerated Salt Fog exposure, this surface coating of zinc extended the appearance of red rust on the surface of the work piece from 4 hours for an untreated piece to 12 hours on the surface of the work piece. This coating was amenable to treatment with a chromate rinse.

Having described the invention in detail and by reference to preferred embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. An article comprising a structure having thereon a corrosion-inhibiting coating comprising:

a zinc source, wherein said zinc source has a zinc concentration greater than or equal to 1.0M and less than or equal to the maximum solubility of said zinc source in water;

a complexing agent for said zinc source, wherein said complexing agent is selected from a nitrogen-containing compound or a phosphorus-containing compound; and a reducing agent.

2. The article as claimed in claim 1, wherein said zinc source is water-soluble.

3. The article as claimed in claim 1, wherein said zinc source is selected from zinc chloride, zinc iodide, zinc iodide, zinc sulfate, zinc chlorate, zinc nitrate, zinc perchlorate, zinc bromate, zinc acetate, zinc fluosilicate, zinc permanganate, zinc propionate, zinc citrate, zinc butyrate, zinc formate, zinc fluoride, zinc lactate, or zinc benzoate.

4. The article as claimed in claim 1, wherein said zinc source has a concentration from about 2.5M to about 5.0M.

5. The article as claimed in claim 1, wherein said nitrogen-containing compound is selected from ammonium compounds, substituted ammonium, ammonia, amines, aromatic amines, porphyrins, amidines, diamidines, guanidines, diguanidines, polyguanidines, biguanides, biguanidines, imidotricarbonimidic diamides. imidotetracarbonimidic diamides, dibiguanides, bis(biguanidines), polybiguanides, poly(biguanidines), imidosulfamides, diimidosulfamides, bis(imidosulfamides), bis(diimidosulfamides), poly (imidosulfamides), poly(diimidosulfamides), phosphoramidimidic triamides, bis(phosphoramidimidic triamides), poly (phosphoramidimidic triamides), phosphoramidimidic acid, phosphorodiamidimidic acid, bis(phosphoramidimidic acid), bis(phosphorodiamidimidic acid), poly (phosphoramidimidic acid), poly(phosphorodiamidimidic acid), phosphonimidic diamides, bis(phosphonimidic diamides), poly(phosphonimidic diamides), phosphoramidimidic acid, bis(phosphoramidimidic acid), poly (phosphoramidimidic acid), azo compounds, formazan compounds, azine compounds, Schiff Bases, hydra zones, or hydramides.

6. The article as claimed in claim 1, wherein a ratio of said complexing agent to said zinc source is from about 05:1 to about 4:1.

7. The article as claimed in claim 1, wherein a ratio of said complexing agent to said zinc source is from about 2:1 to about 4:1.

8. The article as claimed in claim 1, wherein the reducing agent is selected from formats, borohydride, tetrephenylborate, hypophosphite, hydroxylamine, hydroxamates, dithionite, trivalent titanium, trivalent vanadium, or divalent chromium.

9. The article as claimed in claim 9, further comprising an additional metal source.

10. The article as claimed in claim 9, wherein said additional metal source is selected from manganese, cadmium, iron, tin, copper, nickel, indium, lead, antimony, bismuth, cobalt, or sliver.

11. An article comprising a structure having thereon a corrosion-inhibiting coating comprising:

a zinc source;

a complexing agent for said zinc source, wherein said complexing agent is selected from a nitrogen-containing compound or a phosphorus-containing compound;

a reducing agent; and a preparative agent.

12. The article claim 11, wherein said preparative agent is a fluoride source.

13. The article as claimed in claim 12, wherein said fluoride source is selected from hydrofluoric acid, ammonium fluoride, lithium fluoride, sodium fluoride, potassium fluoride, potassium bifluoride, zinc fluoride, aluminum fluoride, hexafluorozirconates, hexafluorotitanates, hexafluorosilicates, fluoroaluminates, fluoroborates, fluorophosphates, or fluoroantimonates.

14. The article as claimed in claim 11, wherein said preparative agent is selected from sulfuric acid, hydrochloric acid, hydrobromic acid, hydriodic acid, phosphoric acid, phosphorus acid, boric acid, or carboxylic acid.

15. The article as claimed in claim 11, wherein said preparative agent has a concentration from about 0.2M to about 0.6M.

16. An article comprising a structure having thereon a corrosion-inhibiting coating comprising:

a zinc source;

a complexing agent for said zinc source, wherein said complexing agent is selected from a nitrogen-containing compound or a phosphorus-containing compound, and wherein said phosphorus-containing compound is selected from phosphines, aromatic phosphines, or substituted phosphonium ions ($PR_4^+$) wherein R is an alkyl, aromatic, or acyclic organic constituent of a $C_1$ to $C_8$; and a reducing agent.

17. An article comprising a structure having thereon a corrosion-inhibiting coating comprising:

a zinc source;

a complexing agent for said zinc source, wherein said complexing agent is selected from a nitrogen-containing compound or a phosphorus-containing compound; and a reducing agent, wherein said reducing agent has a reduction potential lower than −0.76 volts in acidic conditions.

18. An article comprising a structure having thereon a corrosion-inhibiting coating comprising:

a zinc source;

a complexing agent for said zinc source, wherein said complexing agent is selected from a nitrogen-containing compound or a phosphorus-contain compound; and a reducing agent, wherein said reducing agent has a reduction potential lower than −1.04 volts under basic conditions.

19. An article comprising a structure having thereon a corrosion-inhibiting coating comprising:

a zinc source;

a complexing agent for said zinc source, wherein said complexing agent is selected from a nitrogen-containing compound or a phosphorus-containing compound; and a reducing agent, wherein said reducing agent has a concentration greater than or equal to 0.5M but less than or equal to 1.0M.

20. An article comprising a structure having thereon a corrosion-inhibiting coating comprising:

a zinc source;

a complexing agent for said zinc source, wherein said complexing agent is selected from a nitrogen-containing compound or a phosphorus-containing compound;

a reducing agent; and a thickening agent.

21. The article as claimed in claim 20, wherein said thickening agent is selected from starch, dextrin, gum arabic, albumin, gelatin, glue, saponin, gum mastic, gum xanthan, hydroxyalkyl celluloses, polyvinyl alcohols, polyacrylic acid and its esters, polyacrylamides, ethylene oxide polymers, polyvinylpyrrolidone, alkyl vinyl ether copolymers, colloidal suspensions of aluminum oxide or hydrated aluminum oxide, colloidal suspensions of magnesium oxide or hydroxide, or colloidal suspensions of silicon or titanium oxides.

22. The article as claimed in claim 20, wherein said coating comprises between about 0.1 to about 50 parts by weight per 100 parts by weight of water of said thickening agent.

23. The article as claimed in claim 20, wherein said coating comprises between about 0.1 to about 20 parts by weight per 100 parts by weight of water of said thickening agent.

24. A corrosion-inhibiting coating system comprising a first bath wherein said first bath comprises:

a zinc source;

a complexing agent for said zinc source; and a preparative agent, wherein said preparative agent is a fluoride source.

25. The system as claimed in claim 24, wherein said fluoride is selected from the group consisting of hydrofluoric acid, ammonium fluoride, lithium fluoride, sodium fluoride, potassium fluoride, potassium bifluoride, zinc fluoride, aluminum fluoride, hexafluorozirconates, hexafluorotitanates, hexafluorosilicates, fluoroaluminates, fluoroborates, fluorophosphates, and fluoroantimonates.

26. A corrosion-inhibiting coating system comprising a first bath and a second bath wherein said first bath comprises:

a zinc source, and a complexing agent for said zinc source; and said second bath comprises a reducing agent.

27. The system as claimed in claim 26, wherein said reducing agent has a reduction potential lower than −0.75 volts in acidic conditions.

28. The system as claimed in claim 26, wherein said reducing agent has a reduction potential lower than −1.04 volts under basic conditions.

29. The system as claimed in claim 26, wherein said first bath further comprises an additional metal source.

30. A corrosion-inhibiting coating system comprising a first bath wherein said first bath comprises:

a zinc source;

a complexing agent for said zinc source; and an organic thickening agent.

* * * * *

UNITED STATES PATENT AND TRADEMARK OFFICE

CERTIFICATE OF CORRECTION

PATENT NO. : 6,818,313 B2
DATED : November 16, 2004
INVENTOR(S) : Phelps et al.

It is certified that error appears in the above-identified patent and that said Letters Patent is hereby corrected as shown below:

Column 30,
Line 36, “comprising a structure” should read -- comprising a steel structure --;
Line 50, “zinc chloride, zinc iodide” should read -- zinc chloride, zinc bromide, --;

Column 31,
Line 22, “claim 9,” should read -- claim 1, --;
Line 27, “sliver.” should read -- silver. --;
Lines 54 and 66, “comprising a structure” should read -- comprising a steel structure --;

Column 32,
Lines 9, 20 and 31, “comprising a structure” should read -- comprising a steel structure --;

Column 33,
Line 12, “-0.75” should read -- 0.76 --.

Signed and Sealed this

Twenty-fourth Day of May, 2005

JON W. DUDAS
*Director of the United States Patent and Trademark Office*